US006876825B2

(12) United States Patent
Kurahashi et al.

(10) Patent No.: US 6,876,825 B2
(45) Date of Patent: Apr. 5, 2005

(54) IMAGE FORMING APPARATUS CAPABLE OF EXECUTING IMAGE FORMING JOBS HAVING PRIORITY LEVELS

(75) Inventors: Masahiro Kurahashi, Tokyo (JP); Keizo Isemura, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/603,582

(22) Filed: Jun. 25, 2003

(65) Prior Publication Data

US 2004/0096234 A1 May 20, 2004

(30) Foreign Application Priority Data

Jun. 26, 2002 (JP) ..... 2002-185989

(51) Int. Cl.[7] ..... G03G 15/00
(52) U.S. Cl. ..... 399/82
(58) Field of Search ..... 399/82, 87, 88

(56) References Cited

U.S. PATENT DOCUMENTS 6,223,009 B1 * 4/2001 Niitsuma ..... 399/82
6,246,926 B1 * 6/2001 Ishii et al. ..... 700/223

FOREIGN PATENT DOCUMENTS

EP 499719 A1 * 8/1992 ..... G03G/15/00
JP 10190897 A * 7/1998 ..... H04N/1/00

* cited by examiner

*Primary Examiner*—Quana Grainger
(74) *Attorney, Agent, or Firm*—Rossi, Kimms & McDowel

(57) ABSTRACT

There is provided an image forming apparatus which can output a job with a higher priority level in a timely manner without processing other jobs first, when a container has been attached to the image forming apparatus. Images on sheets are formed in accordance with an image forming job by a color MFP 104. The sheets on which the images have been formed is conveyed to a stacker tray 1207 detachably attached to an inserter 108 attached to the black-and-white MFP 105. Storage of the sheets on which the images have been formed in the stacker tray 1207 is controlled to selectively inhibit or allow the storage according to the priority level of the image forming job by a CPU 1805 of the color MFP 104.

8 Claims, 26 Drawing Sheets

*FIG. 19*

| ADDRESS | | |
|---|---|---|
| 0x00 | JOB MANAGER NAME, TRAY NAME | |
| 0x02 | {JOHNxxxx, TRAY 1} | |
| ··· | JOB NUMBER {JOB 3} | |
| | PRINTER NUMBER {BLACK-AND-WHITE MFP 105} | |
| | PRIORITY LEVEL {L1} | |
| | SHEET SIZE {A4} | |
| | MATERIAL {THICK PAPER} | |
| | NUMBER OF COPIES {5} | |
| | NUMBER OF SHEETS {20} | |
| | STACKING INFORMATION | |
| | {STATE A : | AREA 0 |
| | BLACK-AND-WHITE, FACE DOWN & FIRST PAGE PROCESSING | |
| | COLOR, FACE UP & LAST PAGE PROCESSING | |
| | BLACK-AND-WHITE IMAGE PAGE NUMBERS = 3, 4, 5, 10, 12··· | |
| | COLOR IMAGE PAGE NUMBERS = 1, 2, 6, 7···} | |
| | ····· | |
| 0x50 | JOB NUMBER {JOB 4} | |
| 0x52 | PRINTER NUMBER {BLACK-AND-WHITE MFP 105} | |
| ···1 | SHEET SIZE {A4} | AREA 1 |
| | STACKING METHOD | |
| | {STATE B : | |
| | ··· | |
| | | AREA n |

MEMORY MAP

IMAGE FORMING APPARATUS CAPABLE OF EXECUTING IMAGE FORMING JOBS HAVING PRIORITY LEVELS

BACKGROUND OF THE INVENTION

1. Field of the Invention

The present invention relates to an image forming apparatus and in particular to an image forming apparatus that executes image forming jobs that have priority levels.

2. Description of the Related Art

Conventionally, in a system where a color image forming apparatus (color copy apparatus) and a black-and-white image forming apparatus (black and white copy apparatus) are connected to a network, when the images of a plurality of originals that contain both color originals and black-and-white originals are copied and printed out, users have been able to obtain a print result in which both color image pages and black-and-white image pages are mixed by having the images of all of the plurality of originals printed out by the color copy apparatus.

On the other hand, image formation processing by a color copy apparatus takes longer and is more costly than image formation processing by a black-and-white copy apparatus, so that there are demands for having the black-and-white originals in a plurality of originals in which both color originals and black-and-white originals are mixed printed out by a black-and-white copy apparatus. To meet such demands, when the images of a plurality of originals in which both color originals and black-and-white originals are mixed are copied and printed out, it is conceivable to have the black-and-white originals printed out by the black-and-white copy apparatus and the color originals printed out by the color copy apparatus.

In this case, in order to combine the recording sheets that have been printed by the black-and-white copy apparatus and the recording sheets that have been printed by the color copy apparatus into a single bundle like the original plurality of originals, the user has had to insert the recording sheets outputted by one of the copy apparatuses into the recording sheets outputted by the other copy apparatus by hand in order to arrange the originals in the page order.

This means that when the user wishes to collect a plurality of printed sheets together into a single document, part of the task cannot be performed by computer and the user has had to spread out the printed sheets on a desk and perform the task by hand, which has been very inefficient.

To improve this, the following conventional method has been proposed. A stacker tray (storage means) for temporarily storing color output sheets that have been outputted from a color MFP (Multi Function Peripheral) and an insert tray (refeeding means) for inserting color output sheets into black-and-white output sheets outputted from a black-and-white MFP when performing a color/black-and-white mixing are formed of a single common construction (hereinafter such common construction will be referred to as "the stacker tray"). Color output sheets that have been printed by the color MFP, whose output speed is lower than that of the black-and-white MFP, are stacked and stored in the stacker tray, and the stacker tray is attached to an insert apparatus (inserter) of the black-and-white MFP, so that the color output sheets are refed to perform color/black-and-white mixing control.

According to this color/black-and-white mixing control method, a variety of information for mixing color and black-and-white sheets, that is, information such as job numbers related to the color/black-and-white mixing job, designation of a printer for mixing, sheet size, the number of copies, stacking method, and material (a sheet type such as plain paper or thick paper) is set via a server that is connected to the network. Based on the set information, information on color originals is downloaded from the server and/or is read out from a storage means inside the image forming apparatus to form color images, and a color/black-and-white mixing operation is performed for color image sheets and black-and-white image sheets. By doing so, the occurrence of miscopied originals due to input errors by the user when making the settings has been suppressed.

However, with the above-described related art, when miscopies occur due to the erroneous insertion of one of a plurality of stacker trays or due to setting errors when a stacker tray is attached to an inserter, a large burden is placed on the user. In particular, setting errors for an inserter in the case where a plurality of black-and-white and color image forming apparatuses are connected via the network cause a large number of miscopies to be made and result in significant downtime. Also, in recent years there has been increasing demand for color/black-and-white mixing jobs of small lot sizes, so that it is desirable to stack output sheets for a plurality of jobs in a stacker tray.

According to one proposed solution of the above problem, the stacker tray is internally equipped with a memory that can be read and written and a variety of information on a plurality of jobs for performing color/black-and-white mixing is stored in advance in the memory. When the stacker tray is attached to an inserter, such information is automatically read. By performing color/black-and-white mixing control for one job or a plurality of jobs using such information, the erroneous attachment of the stacker tray and setting errors can be avoided.

FIG. 27 is a schematic diagram showing an image forming system comprised of a color MFP 2001 and a black-and-white MFP 2003, according to the proposed solution. It should be noted that in the illustrated example, output sheets related to a job that originally has a lower priority level are stacked on top of output sheets related to a job that originally has a higher priority level. A stacker 2002 is attached to the color MFP 2001 and is comprised of a stacker tray 2011 that is detachably attached and stores color output sheets, a storage device 2012 that stores a variety of information on a plurality of jobs, a lifter unit 2013 that can be raised and lowered and stacks color output sheets thereon, a discharge opening through which color output sheets are discharged from the color MFP 2001 to the stacker tray 2011, a sensor 2015 that detects a sheet surface inside the stacker tray 2011, a sensor 2016 that detects a position of the lifter unit 2013, a sensor 2017 that detects the attachment of the stacker tray 2011, gears 2018, 2019 that constitute a lifting mechanism for the lifter unit 2013, and so forth.

An inserter 2004 is attached to the black-and-white MFP 2003, and is comprised of a sensor 2021 that detects the attachment of the stacker tray 2011, sheet feeding rollers 2022 that feed black-and-white output sheets to an inside of the stacker tray, a multiple feeding prevention roller 2023 that prevents a plurality of black-and-white output sheets from being fed together, and so forth. After being detached from the stacker 2002 which is attached to the above-described color MFP 2001, the stacker tray 2011 can be attached to the inserter 2004. A large-capacity stacker 2005 is attached to the inserter 2004 and is comprised of a sensor 2031 that detects the attachment of the stacker tray 2011, a discharge opening 2032 through which output sheets are discharged from the inserter 2004, and so forth. Also, the above-described stacker tray 2011 can be detachably attached to the large-capacity stacker 2005 in the same way as with the inserter 2004.

However, there has been the following problem with the proposed solution described above. When a large number of output sheets that relate to a plurality of jobs have been stacked in the stacker tray 2011, if, as shown in FIG. 27 referred to, the stacker tray 2011 is attached to the inserter 2004 in a state where output sheets relating to a job with a lower priority level have been stacked on top of output sheets relating to a job with a higher priority level, output will be performed starting with the job with the lower priority level. This means that it is difficult to output the job with the higher priority level in a timely manner.

SUMMARY OF THE INVENTION

It is an object of the present invention to provide an image forming apparatus which can output a job with a higher priority level in a timely manner without processing other jobs first, when a container has been attached to the image forming apparatus.

To attain the above object, in a first aspect of the present invention, there is provided an image forming apparatus comprising an image forming device that forms images on sheets in accordance with an image forming job, a container capable of being detachably attached to the image forming apparatus, a conveying device that conveys the sheets on which the images have been formed to the container, and a controller that controls storage of the sheets on which the images have been formed in the container to selectively inhibit or allow the storage according to a priority level of the image forming job.

Preferably, the controller is operable when the priority level of an image forming job to be executed is lower than the priority level of another image forming job for sheets stored in the container, for inhibiting the storage of sheets for the image forming job to be executed in the container.

More preferably, the controller is operable when the priority level of an image forming job to be executed is lower than the priority level of another image forming job for sheets stored in the container, for inhibiting execution of the image forming job to be executed.

Preferably, the controller is operable when the priority level of the priority level of an image forming job for sheets stored in the container is highest, for inhibiting storage of sheets in the container.

Preferably, the image forming apparatus comprises an input device that inputs an image forming job and a priority level of the input image forming job.

Preferably, the image forming apparatus comprises a setting device that sets the priority level of the image forming job.

To attain the above object, in a second aspect of the present invention, there is provided an image forming apparatus comprising an image forming device that forms images on sheets in accordance with an image forming job, a discharge device that discharges the sheets on which the images have been formed by the image forming device, and a controller that controls the image forming device to selectively inhibit or allow image formation by the image forming device according to a priority level of the image forming job.

According to the present invention, control is performed, in accordance with a determination result for priority levels of image forming jobs, as to whether to inhibit conveying a sheet, which has been subjected to image formation, to a container that has been detachably attached to the image forming apparatus. As a result, when the container is attached to an image forming apparatus, other jobs are not processed before a job with a higher priority level, which can therefore be outputted in a timely manner.

The above and other objects, features, and advantages of the present invention will become more apparent from the following detailed description taken in conjunction with the accompanying drawings.

BRIEF DESCRIPTION OF THE DRAWINGS

FIGS. 8A and 8B show the constructions and various signals of a PWM section 207 and a printer section 208 appearing in FIG. 2, in which:

FIG. 8A is a block diagram showing the constructions of the PWM section 207 and the printer section 208; and FIG. 8B showing the various signals;

FIG. 19 shows a memory map of the storage device 1202;

FIGS. 26A to 26D are diagrams useful in explaining processing for setting and changing settings of priority levels displayed by an operation part of the server computer 102, in which:

FIG. 26A shows a job priority setting screen for a case where priority levels of job A and job B are set to be "normal";

FIG. 26B shows a stacking state of output sheets in the stacker tray 1207 for the case where the priority levels of job A and job B are set to be "normal";

FIG. 26C shows a job priority level setting screen for a case where the priority level of job A is set to be "high"; and FIG. 26D shows a stacking state of output sheets in the stacker tray 1207 for the case where the priority level of job A is set to be "high"

DETAILED DESCRIPTION OF THE PREFERRED EMBODIMENTS

The present invention will now be described in detail with reference to the accompanying drawings showing preferred embodiments thereof.

Figure 1:
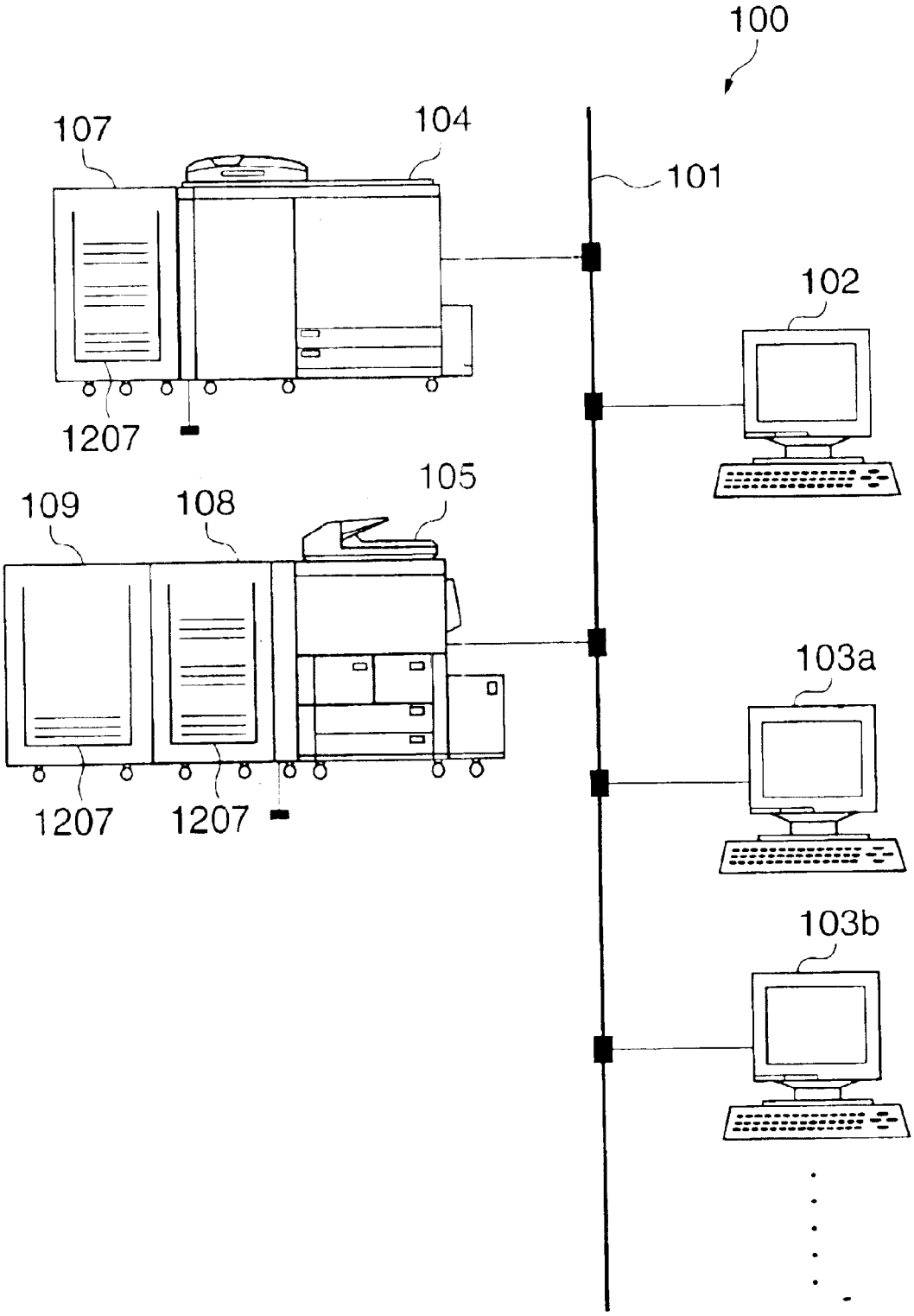
FIG. 1 is a schematic diagram showing the overall construction of an image forming network system which includes an image forming apparatus according to an embodiment of the present invention.

FIG. 1 is a schematic diagram showing the entire construction of an image forming network system which includes an image forming apparatus according to an embodiment of the present invention. In FIG. 1, an image forming network system 100 is constructed, for example, such that a color image forming apparatus (color MFP) 104 as an MFP to which a stacker 107 is attached on an output sheet discharge side thereof, a black-and-white image forming apparatus 105 as an MFP to which an inserter 108 and a large-capacity stacker 109 are attached on an output sheet discharge side thereof, a server computer 102, and client computers 103*a* and 103*b* are connected to each other via a network 101. Although not illustrated in FIG. 1, other image forming apparatuses aside from those mentioned above and appliances such as scanners, printers, facsimile machines are also connected on the network 101. Also, though not illustrated in FIG. 1, a plurality of clients aside from the client mentioned above are connected on the network 101, and these clients will be referred to as hereinafter by the client computer 103.

The color MFP 104 can scan and print, etc., in full color and sheets outputted by the color MFP 104 are successively stacked and stored in a stacker tray 1207 inside the stacker 107 that is attached to the color MFP 104. The inserter 108 that will be described later can also be optionally attached to the color MFP 104. The black-and-white MFP 105 can scan and print, etc., in monochrome and sheets outputted by the black-and-white MFP 105 are successively stacked and stored in the stacker tray 1207 inside the inserter 108 and the large-capacity stacker 109 that are attached to the black-and-white MFP 105.

Here, the stacker trays 1207 can be attached to and detached from the stacker 107, the inserter 108, and the large-capacity stacker 109. By attaching the stacker tray 1207, in which color output sheets on which images have been formed by the color MFP 104 have been stacked, to the inserter 108, the black-and-white MFP 105 can be made into a system capable of mixing color output sheets and black-and-white output sheets, with the mixed output sheets being discharged to buckets for offline post-handling and binding, etc., being performed by a post-handling apparatus, not illustrated.

By causing application software that performs so-called "DTP" (Desk Top Publishing) to run on the client computer 103, it is possible to create and edit a variety of originals and graphics. The client computer 103 converts the created originals and/or graphics to a PDL (Page Description Language), and the resulting PDL originals and/or graphics are sent to the color MFP 104 and/or black-and-white MFP 105 via the network 101, to be printed out by the color MFP 104 and/or the black-and-white MFP 105. The color MFP 104 and black-and-white MFP 105 each have a communication means that can exchange information with the server computer 102 and the client computer 103 via the network 101, whereby the server computer 102 and the client computer 103 are sequentially notified of information on and the statuses of the color MFP 104 and/or the black-and-white MFP 105. The server computer 102 and the client computer 103 have utility software that receives such information and operates, so that the color MFP 104 and the black-and-white MFP 105 can be managed by the server computer 102 and the client computer 103.

The respective constructions of the color MFP 104 and the black-and-white MFP 105 will be described next with reference to FIGS. 2 to 12. The difference between the color MFP 104 and the black-and-white MFP 105 lies in the difference between color and monochrome. Aside from the parts related to color processing, many parts of full-color apparatuses contain the same constructions as those of monochrome apparatuses, so that the following description will focus on the full-color apparatuses, with further explanation of monochrome apparatuses being added as necessary.

Figure 2:
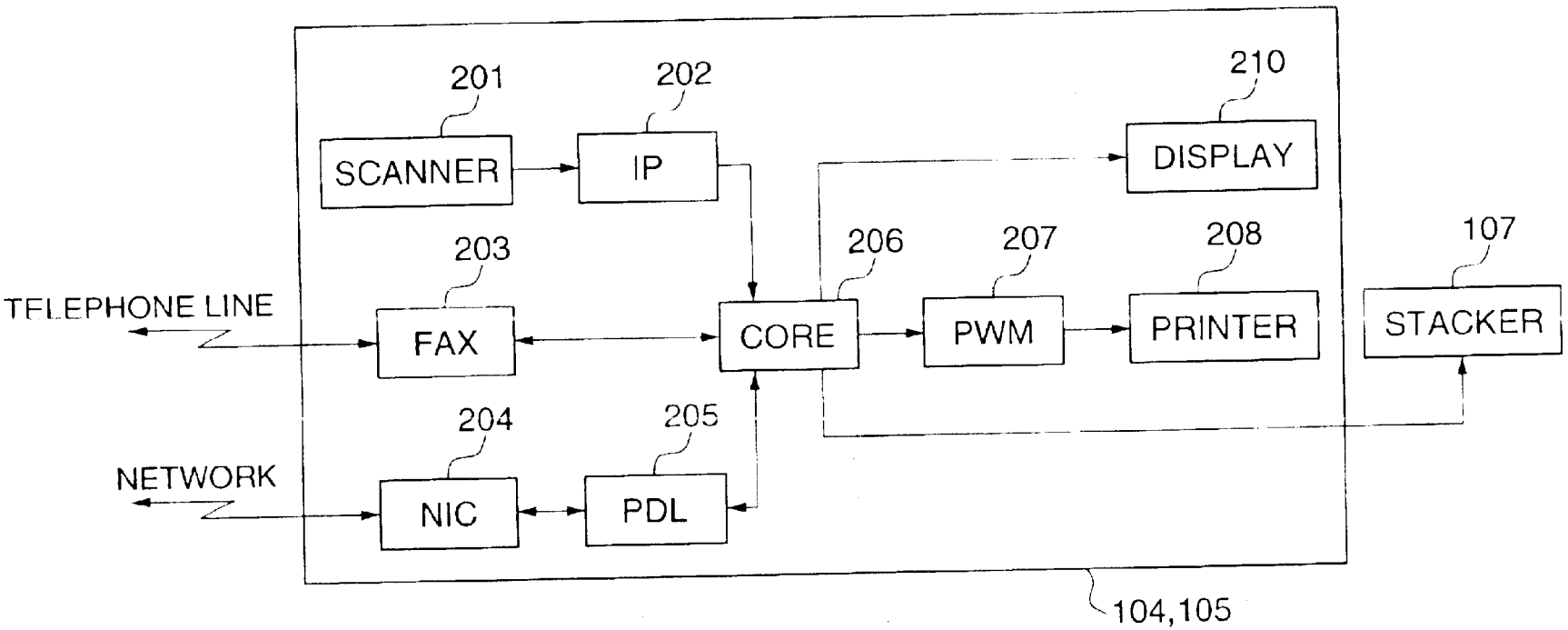
FIG. 2 is a block diagram showing the overall constructions of a color MFP 104 and a black-and-white MFP 105 appearing in FIG. 1.

As shown in FIG. 2, the color MFP 104 and the black-and-white MFP 105 each have a scanner section 201 that reads an image, an image processing section (hereinafter, "IP section") 202 that performs image processing on the read image data, a FAX section 203 that transmits and receives images using a telephone line, like a facsimile machine, a NIC (Network Interface Card) section 204 that exchanges image data and apparatus information using a network, a PDL section 205 that converts the PDL sent from the client computer 103 into an image signal, a core section 206 that switches between paths and compresses and decompresses image data, a PWM (Pulse Width Modulation) section 207 that converts image data outputted from the core section 206 into a laser beam, a printer section 208 that performs image formation on a sheet, and a display section 210 that converts and displays the image data outputted from the core section 206.

Depending on the way in which the color MFP 104 and the black-and-white MFP 105 are used, image signals are temporarily stored and have a path decided by the core section 206. Next, the image data outputted from the core section 206 is sent to the printer section 208 that performs image formation. Sheets that have been printed by the printer section 208 are fed into the stacker 107 and are successively stacked. The display section 210 is used to confirm the contents of images without the images being printed and to preview images before printing.

Figure 3:
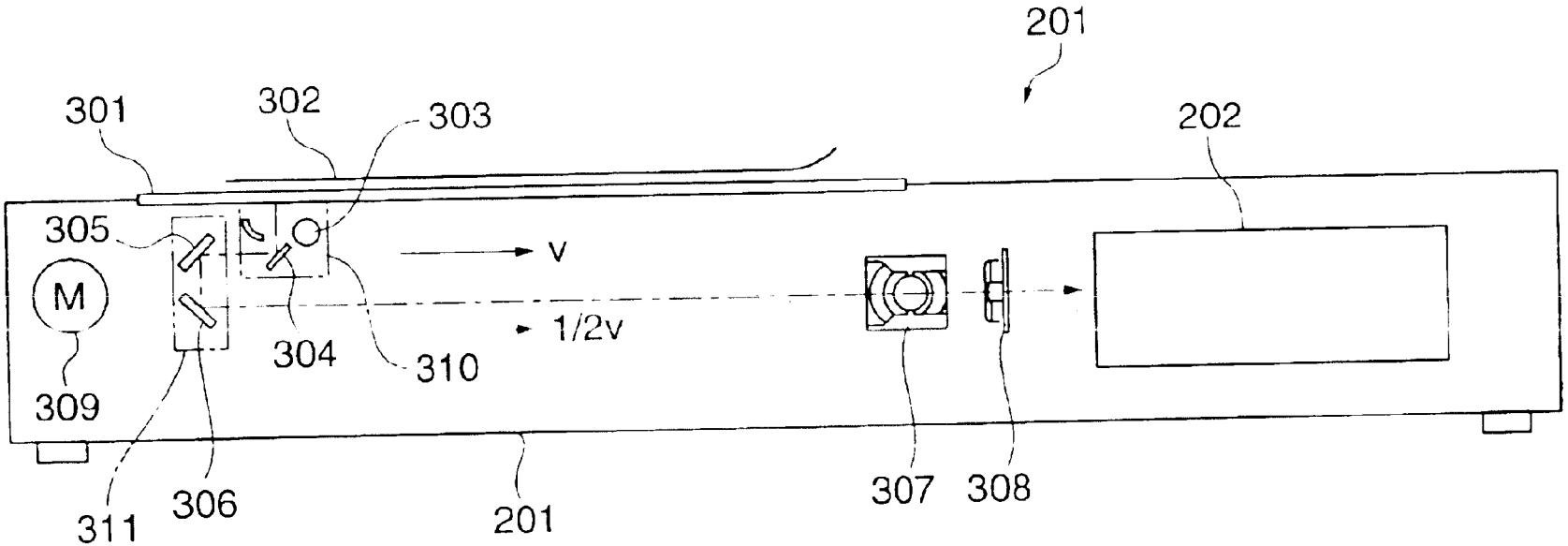
FIG. 3 is a block diagram showing the internal construction of a scanner section 201 appearing in FIG. 2.

Next, the construction of the scanner section 201 will be described with reference to FIG. 3. An original 302 to be read is placed on a platen glass 301. The original 302 is illuminated by an illuminating lamp 303, and the reflected light passes a mirror 304 of a first mirror section 310 and mirrors 305, 306 of a second mirror section 311 to form an image on a CCD sensor 308 by a lens 307. The first mirror section 310 that includes the illuminating lamp 303 and the mirror 304 is moved at a velocity V by a moving mechanism, and the second mirror section 311 that includes the mirrors 305, 306 is moved at a velocity (½)V by a moving mechanism so that the entire surface of the original 302 is scanned. The first mirror section 310 and the second mirror section 311 are driven by a motor 309.

Figure 4:
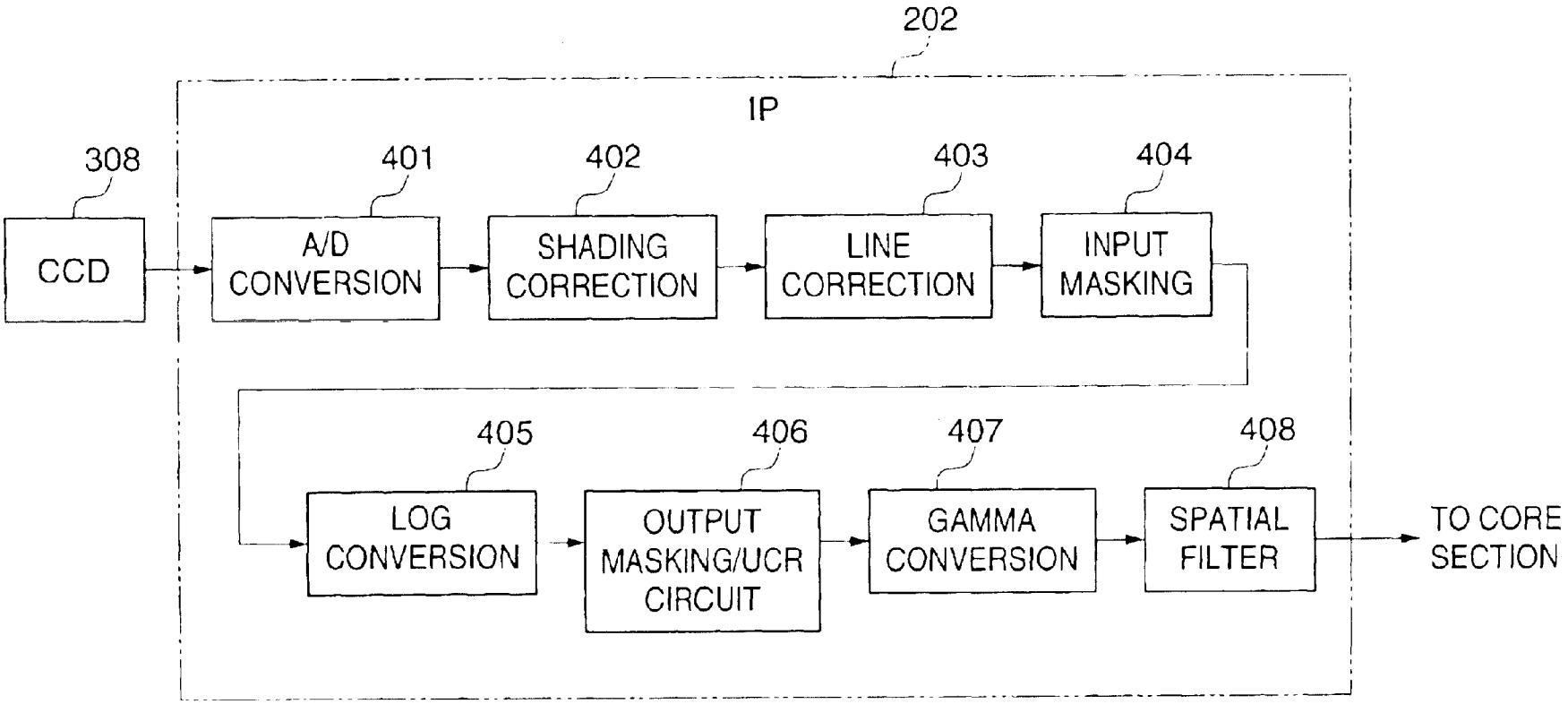
FIG. 4 is a block diagram showing the construction of an IP section 202 appearing in FIG. 2.

Next, the construction of the IP section 202 will be described with reference to FIG. 4. An optical signal inputted via the scanner section 201 is converted into an electric signal by the CCD sensor 308.

This CCD sensor 308 is a 3-line color sensor for R (Red), G (green), and B (blue), and separate image signals for R, G, and B from the CCD sensor 308 are inputted into an A/D conversion section 401 of the IP section 202. After gain adjustment and offset adjustment have been performed by the A/D conversion section 401, the signals for the respective colors are converted into 8-bit digital image signals R0, G0, and B0. Thereafter, each color is subjected to a well-known shading correction by a shading correction section 402 using a read signal from a reference white plate. In addition, the line sensors for the respective colors in the CCD sensor 308 are arranged at intervals of a predetermined distance from one another, so that spatial misalignments in the sub-scanning direction are adjusted by a line delay adjusting circuit (line correction section) 403.

An input masking section 404 converts a read color space that is determined by the spectral characteristics of R, G, B filters of the CCD sensor 308 to a standard color space according to NTSC (National Television System Committee) Standards, and performs a 3×3 matrix calculation using constants that are unique to the apparatus and have been determined with various characteristics taken into account, such as the sensitivity characteristics of the CCD sensor 308 and the spectral characteristics of the illuminating lamp, thereby converting the inputted (R0, G0, B0) signals into standard (R, G, B) signals. In addition, a luminance/density conversion section (LOG conversion section) 405 is composed of a look-up table (LUT) RAM and converts luminance signals for R, G, and B into density signals C1, M1, and Y1.

An output masking/UCR circuit section 406 converts, using a matrix calculation, the C1, M1, and Y1 signals into signals for Y (yellow), M (magenta), C (cyan), and K (black) that are the toner colors of the color MFP 104. The output masking/UCR circuit section 406 converts the C1, M1, Y1, and K1 signals that are based on the R, G, and B signals read by the CCD sensor 308 to a CMYK signal that is based on the spectral distribution characteristics of the toners and outputs the resulting signal. Next, a gamma conversion section 407 converts the CMYK signal into CMYK data for image output using an LUT RAM that takes various color characteristics of the toners into account, a spatial filter 408 carries out sharpening or smoothing processing on the CMYK data, and the resulting image signal is sent to the core section 206.

When monochromatic image processing is performed by the black-and-white MFP 105, A/D conversion and shading may be performed for one color using a monochromatic one-line CCD sensor, and input/output masking processing, gamma conversion processing, and spatial filter processing may then be performed in that order.

Figure 5:
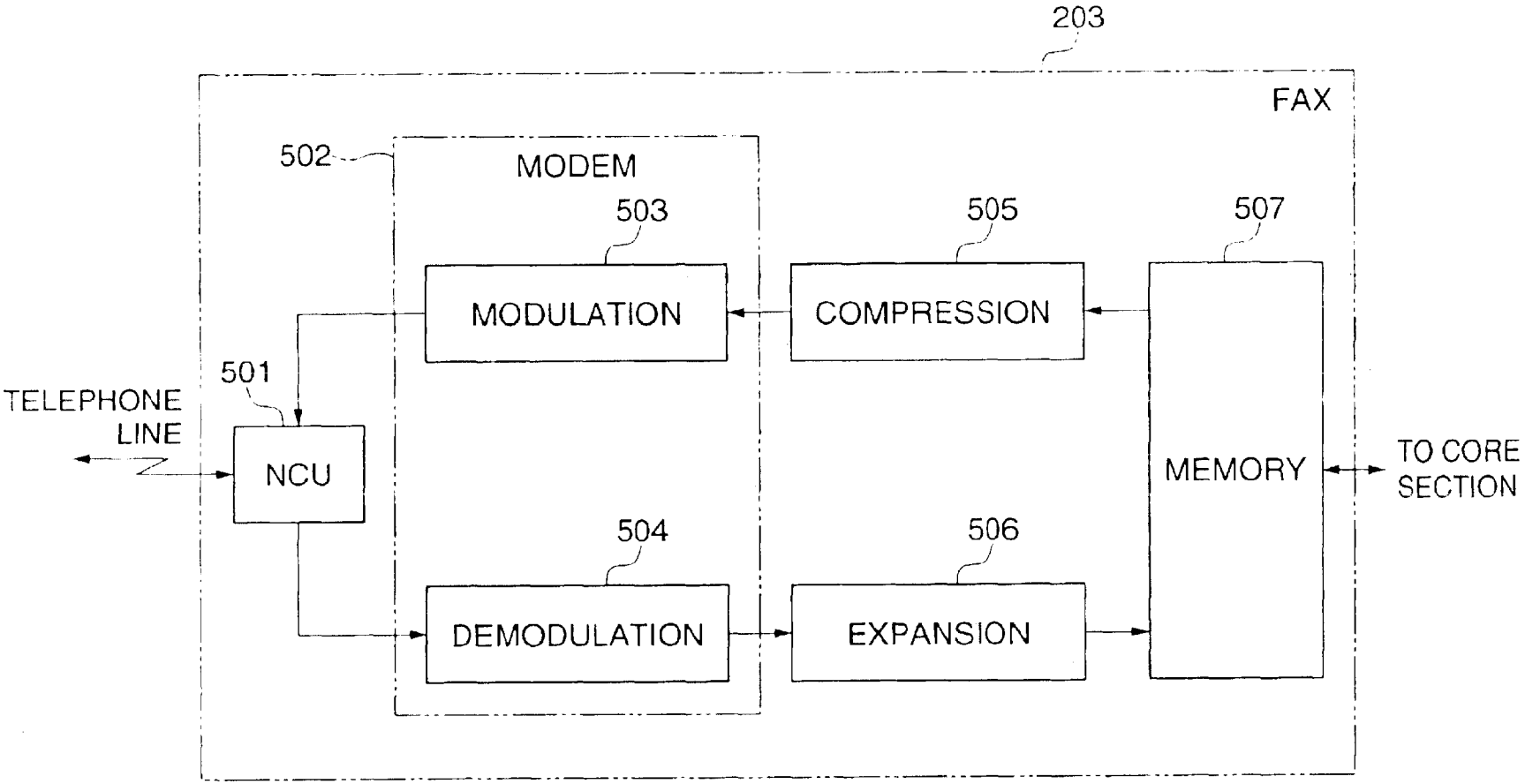
FIG. 5 is a block diagram showing the construction of a FAX section 203 appearing in FIG. 2.

Next, the FAX section 203 will be described with reference to FIG. 5. First, during reception, the reception voltage of data that arrives via a telephone line is converted by an NCU section 501 and then A/D conversion and demodulation operation are performed by a demodulation section 504 inside a modem section 502, before the data is expanded into raster data by an expansion section 506. The run-length method or the like is usually used for compression and expansion by facsimile machines. The image that has been converted into raster data is temporarily stored in a memory 507 and after it has been confirmed that there are no transfer errors in the image data, the image data is sent to the core section 206. During transmission, an image signal for a raster image that is sent from the core section 206 is subjected to compression by the run-length method or the like, by a compression section 505 and, after D/A conversion and modulation operation have been performed by a modulation section 503 in the modem section 502, the image signal is sent to the telephone line via the NCU section 501.

Figure 6:
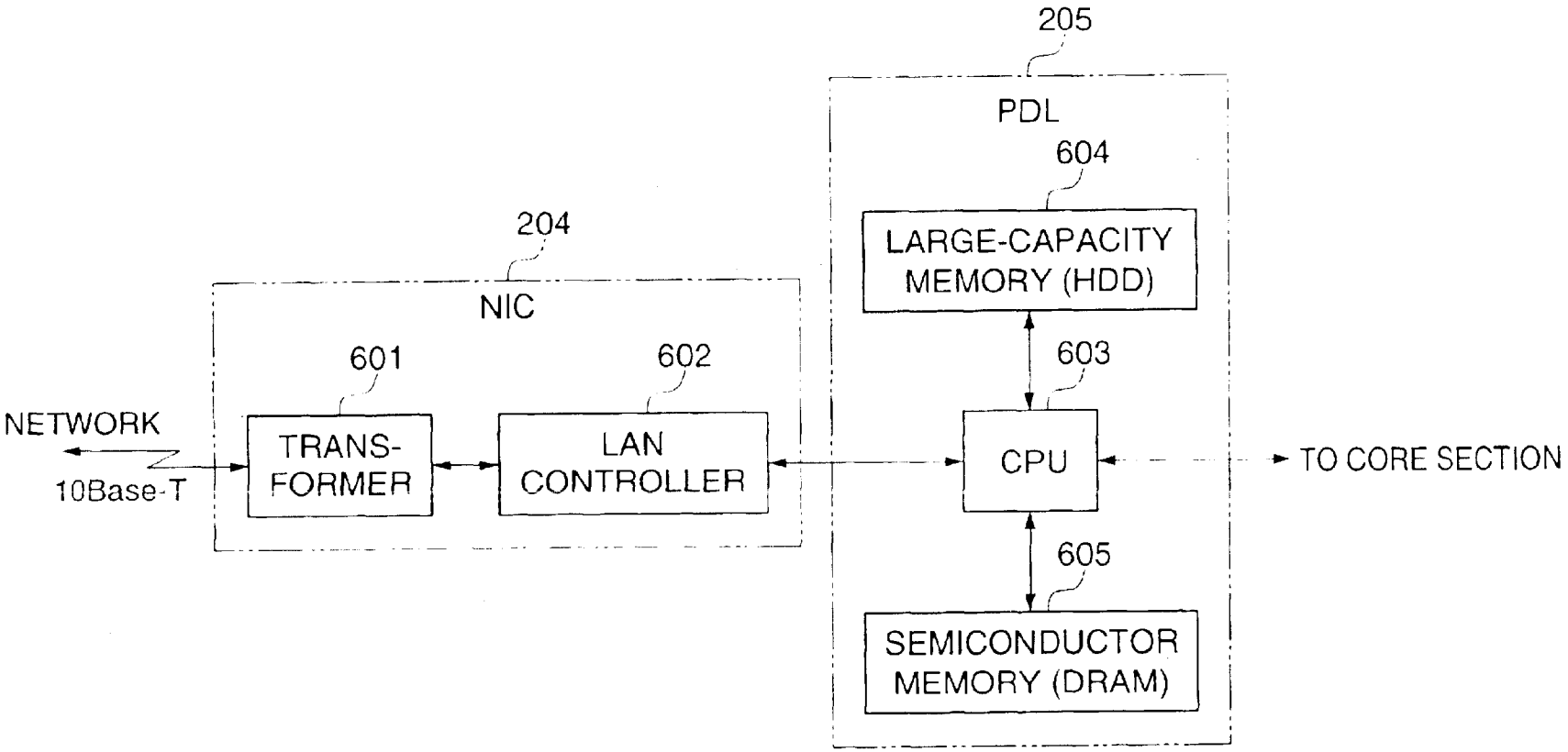
FIG. 6 is a block diagram showing the construction of a NIC section 204 and a PDL section 205 appearing in FIG. 2.

Next, the construction of the NIC section 204 will be described with reference to FIG. 6. The NIC section 204 functions as an interface for the network 101, to obtain information from outside and to supply information to the outside, using an ETHERNET (registered trademark) cable, such as a 10 Base-T/100 Base-TX cable.

When information is obtained from outside, first, a voltage conversion is performed on the information by a transformer section 601 and then the information is sent to a LAN controller section 602. The LAN controller section 602 is internally equipped with a first buffer memory (not shown in the figure) and after it is determined that the information is necessary information, the information is sent to a second buffer memory (not shown in the figure), and then the information signal is sent to the PDL section 205. To supply information to the outside, required information is added by the LAN controller section 602 to data sent from the PDL section 205 and the data is supplied to the network 101 via the transformer section 601.

Next, the construction of the PDL section 205 will be described with reference to FIG. 6. Image data that has been generated by application software that runs on the client computer 103 is composed of text, graphics, photographs, or the like, each of which is composed of a combination of image descriptive elements, such as character codes, graphics codes, and raster image data. This is so-called PDL (Page Description Language), a representative example of which is the POSTSCRIPT (registered trademark) language developed by ADOBE SYSTEMS INCORPORATED.

The PDL section 205 performs a conversion process that converts the above PDL data into raster image data. First, PDL data sent from the NIC section 204 is stored, via a CPU 603, in a large-capacity memory 604, such as a hard-disk drive (HDD), where data is managed and stored for jobs.

Next, as necessary the CPU 603 performs RIP (Raster Image Processing) to expand the PDL data into a raster image. The expanded raster image data is stored in page units for each color component of CMYK for each job in a memory 605, such as a DRAM, that can be accessed at high speed, and depending on the status of the printer section 208, the data is sent back to the core section 206 via the CPU 603.

Figure 7:
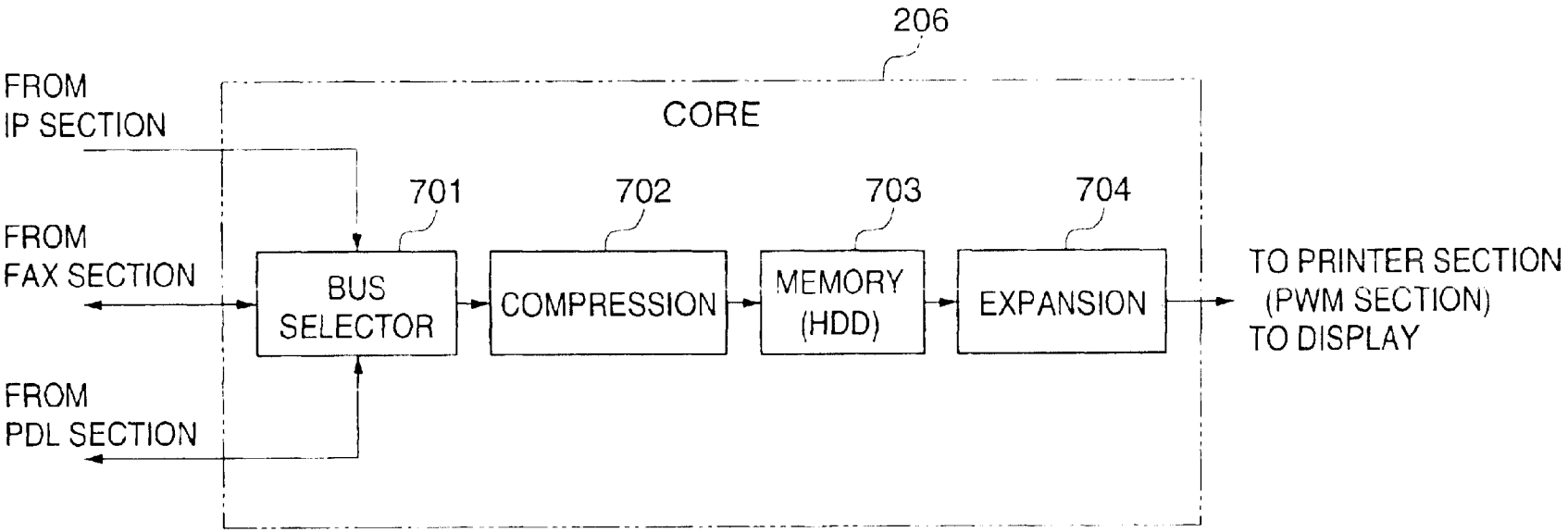
FIG. 7 is a block diagram showing the construction of a core section 206 appearing in FIG. 2.

Next, the construction of the core section 206 will be described with reference to FIG. 7. A bus selector section 701 of the core section 206 performs "traffic control" regarding the use of the color MFP 104 and the black-and-white MFP 105. Specifically, the bus selector section 701 switches the bus in accordance with various functions of the color MFP 104 and the black-and-white MFP 105, such as a copying function, a network scanner function, a network printer function, a facsimile transmission/reception function and a display function.

Patterns of bus switching for performing the various functions are given below.

Copying function: scanner section 201→core section 206→printer section 208

Network scanner function: scanner section 201→core section 206→NIC section 204

Network printer function: NIC section 204→core section 206→printer section 208

Facsimile transmission function: scanner section 201→core section 206→FAX section 203.

Facsimile reception function: FAX section 203→core section 206→printer section 208

Display function: scanner section 201 or FAX section 203 or NIC section 204→core section 206→display section 210.

Next, the image data outputted from the bus selection section 701 is sent to the printer section 208 (the PWM section 207) or the display section 210 via a compression section 702, a memory 703, which is composed of a large-capacity memory such as a hard disk drive (HDD), and an expansion section 704. The compression method used by the compression section 702 may be a common method such as JPEG (Joint Photographic Experts Group), JBIG (Joint Bi-Level Image Experts Group), and ZIP. The compressed image data is managed for each job and is stored together with additional data such as a filename, a creator name, created time and date, and a file size.

Additionally, if a job number and password are provided and stored together with the above information, it is possible to support a personal box function. This is for temporarily storing data and only allowing a specified person to print out (read from the HDD) the data. When an instruction to print out a stored job has been given, authentication is performed using the password, the image data is then called from the memory 703, and image expansion is performed to restore the image data to a raster image, which is sent to the printer section 208.

Figure 8A:
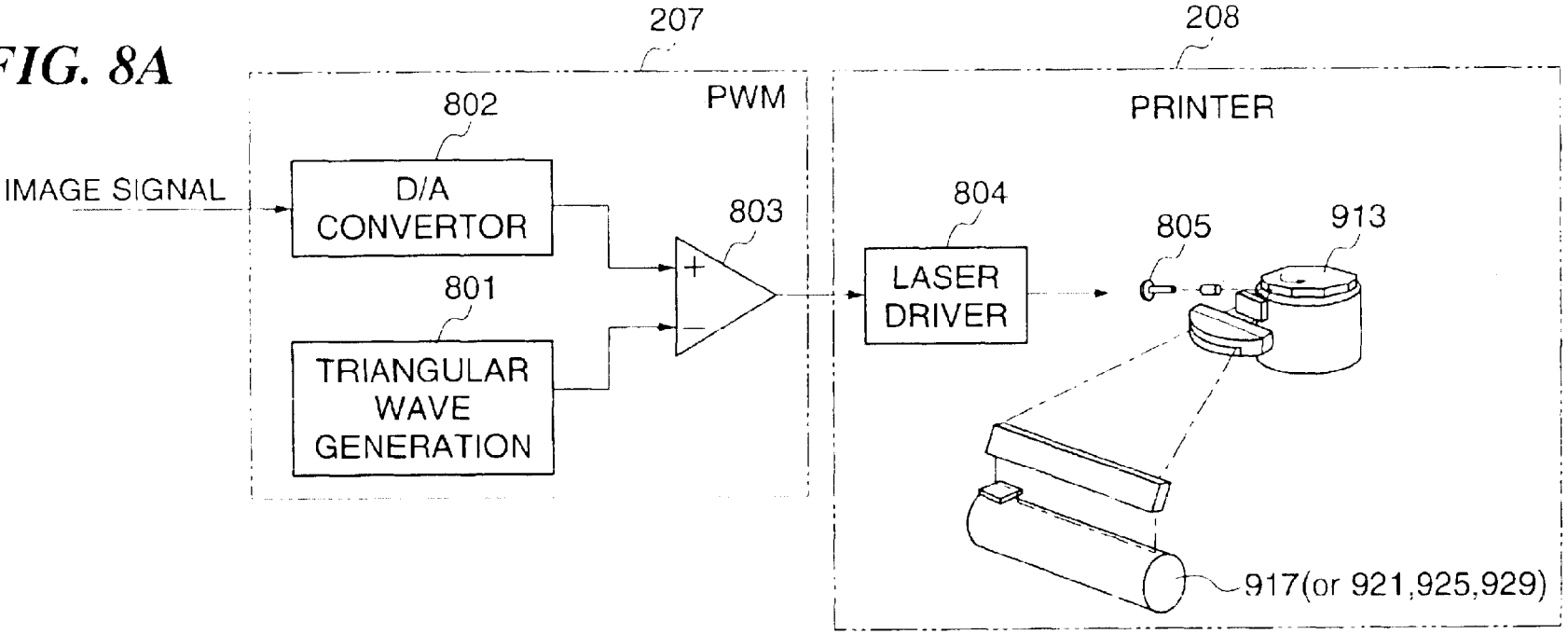
Figure 8B:
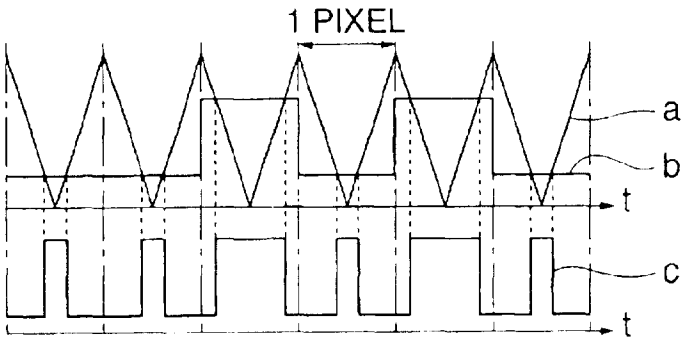

Next, the construction of the PWM section 207 will be described with reference to FIGS. 8A and 8B. A set of image data which have been decomposed into four colors, yellow (Y), magenta (M), cyan (C), and black (K), that have been outputted from the core section 206 (in the case of the black-and-white MFP 105, this is monochrome data) pass the respective PWM sections 207 where image formation is performed for each color. Reference numeral 801 denotes a triangular wave generator, and reference numeral 802 denotes a D/A converter (D/A conversion section) that converts an inputted digital image signal into an analog signal. The sizes of a signal ("a" in FIG. 8B) from the triangular wave generator 801 and a signal ("b" in FIG. 8B) from the D/A converter 802 are compared by a comparator 803, resulting in a signal such as one shown by "c" in FIG. 8B which is sent to a laser driving section 804, where each of the CMYK data is converted into a laser beam by a corresponding one of respective lasers 805 for C, M, Y, and K. A polygon scanner 913 scans the respective laser beams to irradiate respective photosensitive drums 917, 921, 925, and 929.

Figure 9:
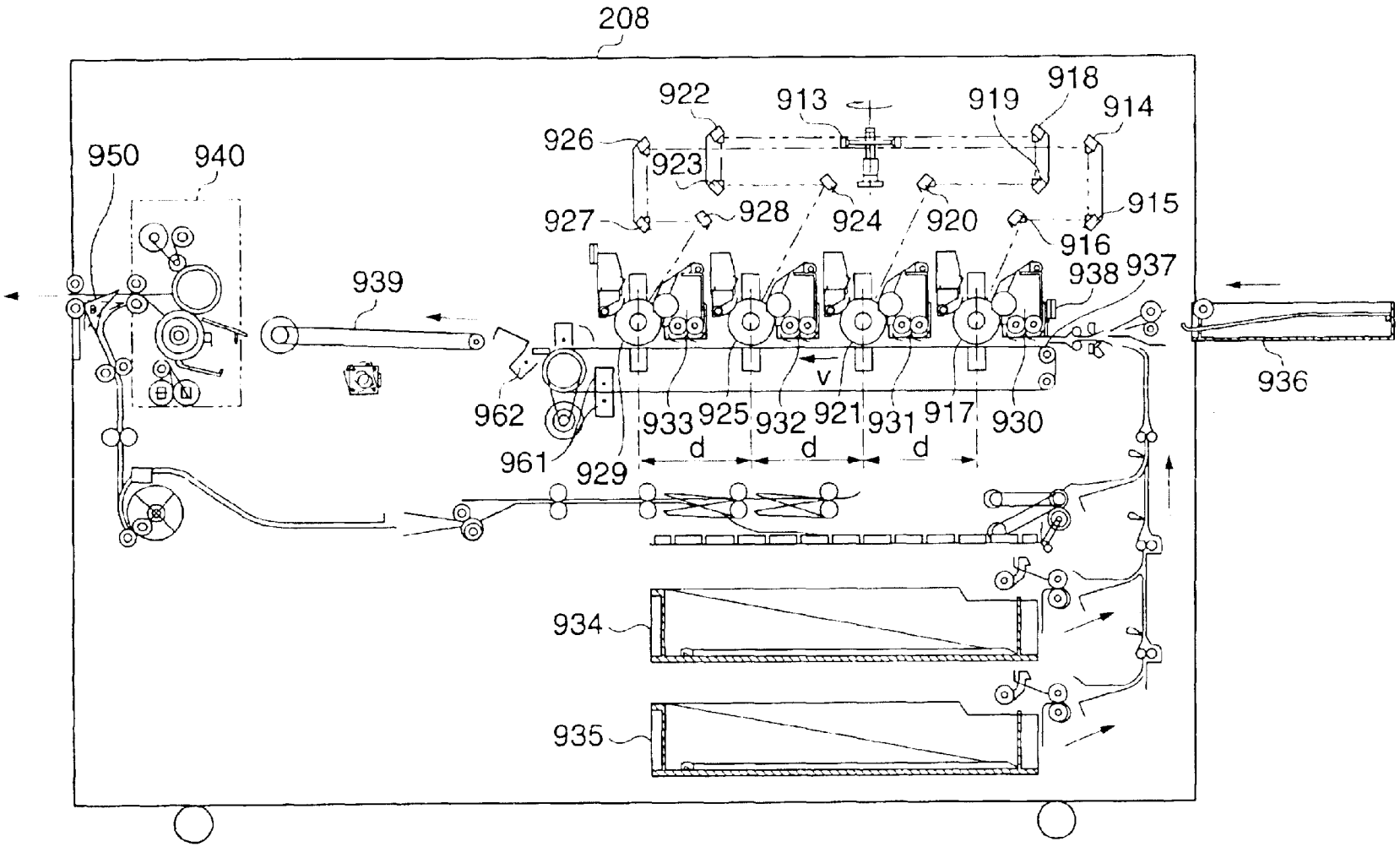
FIG. 9 is a block diagram showing the internal construction of the printer section 208 of the color MFP 104.

Next, the construction of the printer section 208 of the color MFP 104 will be schematically described with reference to FIG. 9. Reference numeral 913 denotes a polygon mirror on which the four laser beams generated by the four semiconductor lasers 805 (see FIG. 8) are incident. Of these, one laser beam passes via mirrors 914, 915, and 916 and scans a photosensitive drum 917, the next laser beam passes via mirrors 918, 919, and 920 and scans a photosensitive drum 921, the next laser beam passes via mirrors 922, 923, and 924 and scans a photosensitive drum 925, and the next laser beam passes via mirrors 926, 927, and 928 and scans a photosensitive drum 929.

On the other hand, reference numeral 930 denotes a developer that supplies yellow (Y) toner, so that a yellow toner image is formed on the photosensitive drum 917 in accordance with the laser light. Reference numeral 931 denotes a developer that supplies magenta (M) toner, so that a magenta toner image is formed on the photosensitive drum 921 in accordance with the laser light. Reference numeral 932 denotes a developer that supplies cyan (C) toner, so that a cyan toner image is formed on the photosensitive drum 925 in accordance with the laser light. Reference numeral 933 denotes a developer that supplies black (K) toner, so that a black toner image is formed on the photosensitive drum 929 in accordance with the laser light. By transferring the toner images of the above four colors (Y, M, C, K) onto a sheet, a full-color output image can be obtained.

A sheet that has been fed from one of sheet cassettes 934 and 935 and a manual feeding tray 936 passes via a resist roller 937, is attached to a transfer belt 938 by attraction, and is conveyed by the belt 938. In synchronization with the sheet feeding, toners of respective colors are used to develop images on the photosensitive drums 917, 921, 925, and 929 in advance and the toners are transferred onto the sheet as the sheet is conveyed. The sheets on which the various color toners have been transferred are separated and are conveyed by a conveying belt 939, and the toner is fixed onto each sheet by a fixer 940. The sheet that comes out of the fixer 940 is discharged. Since each sheet is discharged face up, printing operations are performed in order starting with the last page.

The four photosensitive drums 917, 921, 925, and 929 are arranged at equal intervals of a distance "d", a sheet is conveyed by the conveying belt 939 at a constant velocity V, and the four semiconductor lasers 805 (see FIG. 8A) are driven in synchronization with the conveying timing of the sheet.

Figure 10:
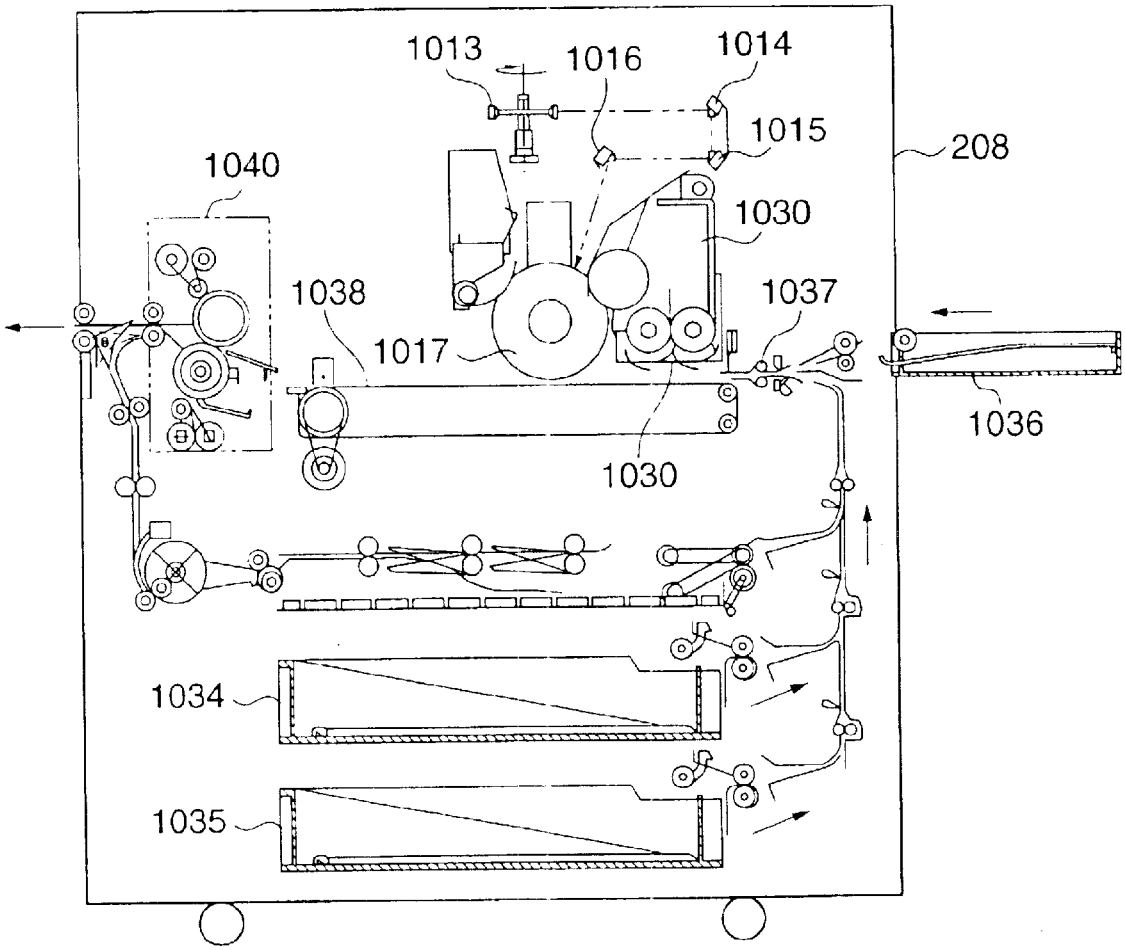
FIG. 10 is a block diagram showing the internal construction of the printer section 208 of the black-and-white MFP 105.

Next, the construction of the printer section 208 of the black-and-white MFP 105 will be schematically described with reference to FIG. 10. Reference numeral 1013 denotes a polygon mirror on which laser beams generated by the four semiconductor lasers 805 (see FIG. 8) are incident. The laser beams pass via the mirrors 1014, 1015, and 1016 and scan a photosensitive drum 1017. On the other hand, reference numeral 1030 denotes a developer that supplies black (K) toner, so that a black toner image is formed on the photosensitive drum 1017 in accordance with the laser light. By transferring the toner image onto a sheet, an output image can be obtained.

A sheet that has been fed from one of sheet cassettes 1034 and 1035 and a manual feeding tray 1036 passes via a resist roller 1037, is attached to a transfer belt 1038 by attraction, and is conveyed by the belt 1038. In synchronization with the timing of the sheet feeding, toner is used to develop an image on the photosensitive drums 1017 in advance and the toner is transferred onto the sheet as the sheet is conveyed. The sheets on which the toner has been transferred are separated and the toner is fixed onto each sheet by a fixer 1040. The sheet that comes out of the fixer 1040 is discharged. Since each sheet is discharged facing upwards, printing operations are performed in order starting with the last page. Also, by using an inverting section 1041, it is possible to perform processing in order starting with the first page with the sheets being discharged facing downwards.

Figure 11:
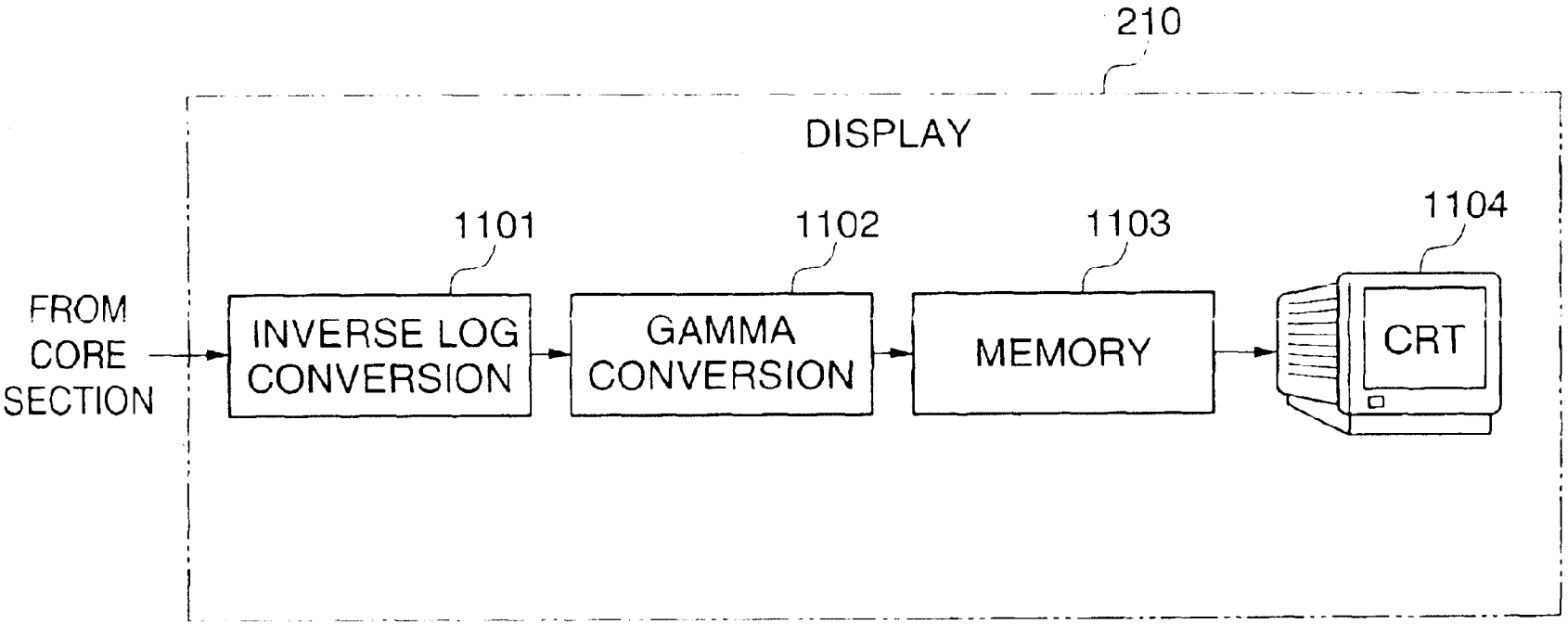
FIG. 11 is a block diagram showing the construction of a display section 210 appearing in FIG. 2.

Next, the construction of the display section 210 will be described with reference to FIG. 11. The image data outputted from the core section 206 is CMYK data, so that it is necessary to convert the data into R, G, and B data in an inverse LOG conversion section 1101. Next, an output conversion is performed by a gamma conversion section 1102 using a look up table so that the data matches the color characteristics of a display device 1104, such as a CRT, on which the data is displayed. The converted image data is temporarily stored in a memory section 1103 and is displayed by the display device 1104.

Here, the display section 210 is used in the case where a preview function for confirming the output image in advance or a proofing function for confirming that the outputted image is definitely the intended image is executed, or when the user wishes to confirm an image to determine whether it requires printing, so that the wasteful usage of print sheets can be avoided.

Next, the utility software that runs on the client computer 103 and the server computer 102 will be described. Standardized databases called MIB (Management Information Bases) are constructed in the network interface parts (the NIC section 204 and the PDL section 205) inside the color MFP 104 and the black-and-white MFP 105. Using a network management protocol called SNMP (Simple Network Management Protocol), communication is performed on the network with the server computer 102 and the client computer 103, so that the color MFP 104, the black-and-white MFP 105, and scanners, printers, facsimile machines, etc., connected on the network can be managed.

On the other hand, software programs called utilities run on the client computer 103 and the server computer 102, so that information can be exchanged as necessary using the MIBs through the use of the above-mentioned SNMP on the network. For example, by using the MIBs when detecting whether the stacker 107 and the stacker trays 1207 have been set as equipment information of the color MFP 104 and the black-and-white MFP 105, when detecting whether printing can presently be performed as status information, or when writing, changing and confirming the names and installing positions of the color MFP 104 and the black-and-white MFP 105, the user can confirm information on the color MFP 104 and the black-and-white MFP 105 that are connected to the network, on the client computer 103 and the server computer 102. These information may be used to distinguish between the server computer 102 and the client computer 103 so that restrictions may be imposed on the reading and writing of each computer.

Therefore, by using these functions, a user can obtain all kinds of information for management and control of the equipment information of the color MFP 104 and the black-and-white MFP 105, the status of apparatuses, the network settings, the progress of processing of jobs, and the usage status of the color MFP 104 and the black-and-white MFP 105.

Figure 13:
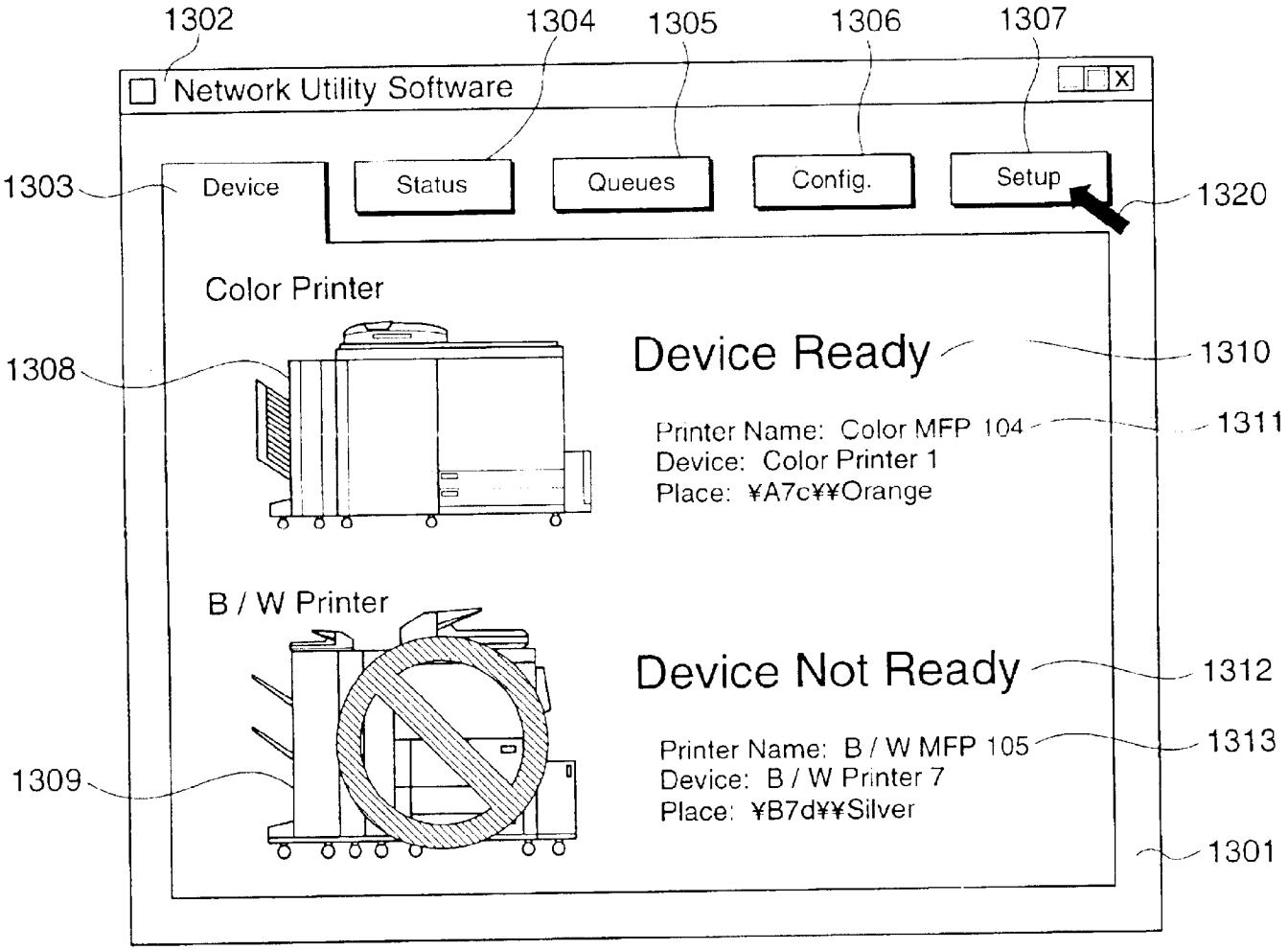
FIG. 13 is a diagram showing an example of a screen according to utility software executed by a server computer 102 or a client computer 103 appearing in FIG. 1.

Next, screens of utility software called a GUI (Graphic User Interface) that runs on the screen of the server computer 102 or the client computer 103 will be described with reference to FIG. 13. When the utility software is launched on the client computer 103 or the server computer 102, a screen shown in FIG. 13 is displayed. Here, reference numeral 1301 denotes a window, and reference numeral 1320 denotes a cursor. When the user clicks on a tab using a mouse, a different window is opened or the display proceeds to the next status. Reference numeral 1302 denotes a title bar which is used to display a position of the present window in a hierarchy and a title. Reference numerals 1303 to 1307 denote tabs that are allotted to different types of information, to display required information, and to select required information.

Here, reference numeral 1303 denotes a "Device" tab which can inform the user of the presence of devices and summaries of such devices. On the "Device" tab 1303, there are bitmap images, denoted by reference numerals 1308 and 1309, that show the color MFP 104 and the black-and-white MFP 105, and the statuses of these MFPs are displayed by messages denoted by reference numerals 1310, 1311, 1312, and 1313. The details of the apparatus statuses can be understood by looking at a "Status" tab 1304. Next, reference numeral 1305 denotes a "Queues" tab, which makes it possible to know the states of jobs that have been queued in each of the apparatuses and how busy each device is.

Next, a "Config." tab 1306 makes it possible to know equipment information such as what functions are provided in a finisher that has been attached. For example, this tab shows whether an inserter or a finisher has been attached to the black-and-white MFP 105, whether a letter-sized paper deck with a capacity of up to 5,000 sheets has been attached, around how many sheets are remaining, or whether a unit for performing two-sided processing has been attached (FIG. 13 shows an example where a finisher has been attached). A "Setup" tab 1307 makes it possible to know network setting information of the apparatuses.

Figure 12:
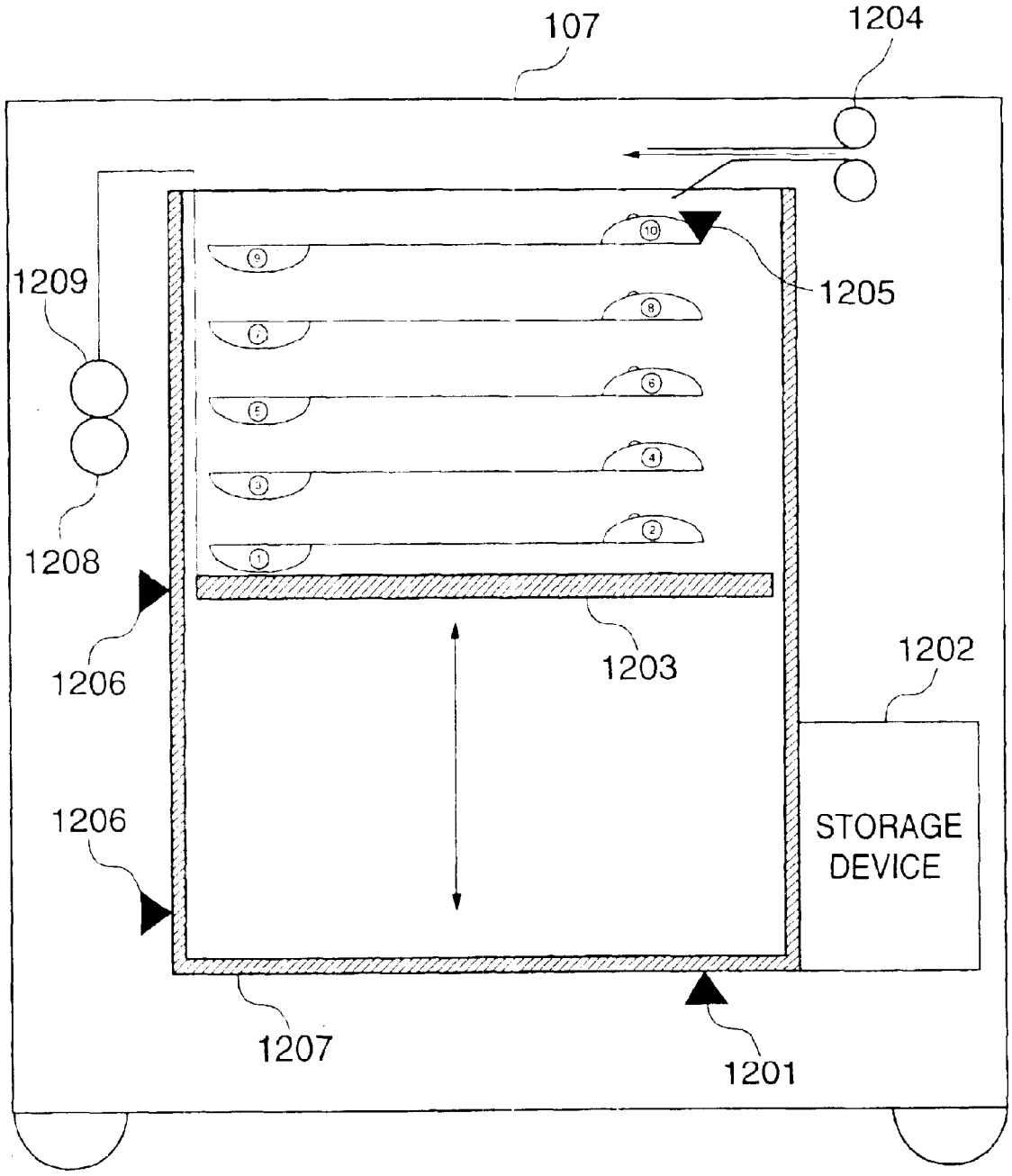
FIG. 12 is a diagram showing a flow of stacking and storage of output sheets by a stacker 107 appearing in FIG. 2.

Next, how the stacker 107 is used to stack and store output sheets of mainly the color MFP 104 will be briefly described with reference to FIG. 12. The stacker tray 1207 is detachably attached to the stacker 107, and in actuality sheets are stacked in this stacker tray 1207. Sheets that have been printed upon by the printer section 208 of the color MFP 104 are fed into the stacker 107, "S-placing mode" or "F-placing mode" is selected as the stacking mode in accordance with the type of job, and the sheets are stacked and stored. Here, assuming, for example, that there are three color image pages to be mixed, a method in which sheets for the same page for each of the set number of copies are stacked is called "S-placing mode", while a method in which sheets for a set of three pages are stacked in order of page is called "F-placing mode". FIG. 12 shows an example where sheets are placed in the stacker tray 1207 in F-placing mode.

A lifter device is comprised of a lifter section 1203, a stacker tray presence detecting sensor 1201, a sheet surface position detecting sensor 1205, a lifter position detecting sensor 1206, and gears 1208 and 1209, that drive the lifter section 1203, and so forth. The lifter section 1203 is controlled so as to keep the height from a discharge port 1204 to the sheet surface constant, based on an output from the sheet surface position detecting sensor 1205 that detects the position of the sheet surface, to thereby improve the stackability of sheets on which image formation has been performed. Also, as one example of a method of driving the lifter section 1203 up and down, a motor (not shown in FIG. 12) that is provided in the stacker 107 can drive the lifter section 1203 up and down by transmitting the driving force via the gear 1208 to the gear 1209 that can wind a wire that is connected to the lifter section 1203.

Figure 18:
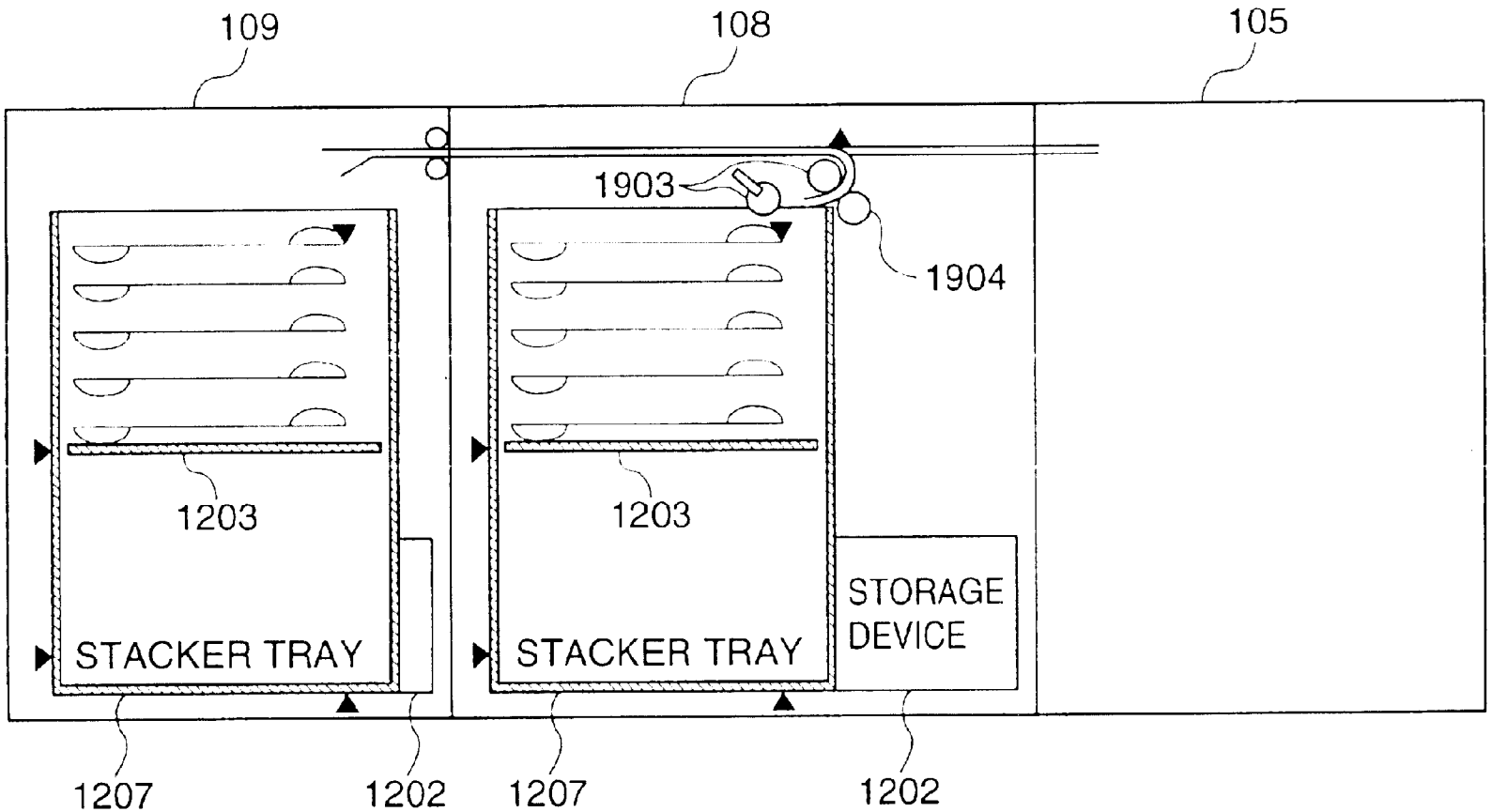
FIG. 18 is a schematic diagram showing an outline of the inserter 108 and a large-capacity stacker 109 attached to the black-and-white MFP 105.

The lifter position detecting sensor 1206 detects the amount of sheets stacked in the stacker tray 1207 by detecting the position of the lifter section 1203, and by providing such sensors 1206 at a plurality of positions, the detection accuracy can be improved. Any type of construction, such as a flag-type sensor, optical sensor, image sensor may be used for the sheet surface position detecting sensor 1205 and the lifter position detecting sensor 1206, with each sensor being provided on the stacker 107 side. As shown in FIG. 18, when the stacker tray 1207 is attached to the inserter 108 and sheets are refed, the lifter device also functions to keep the height of the sheet surface constant relative to a paper feeding roller 1903.

A storage device 1202 is provided on the stacker tray 1207, for writing storage information for performing color/black-and-white mixing where color output sheets on which images have been formed by the color MFP 104 are inserted into black-and-white output sheets on which images have been formed by the black-and-white MFP 105. Here, the storage device 1202 may be used to write insertion information for inserting black-and-white output images into color output images. The insertion information that is written in the storage device 1202 is for example a paper size, a job ID, a print number, the number of output sheets, the number of copies (the number of times sheets for the same page are to be outputted), paper stacking method, and material (a paper type such as plain paper or thick paper), and these information is used for matching color data and black-and-white data with each other and page alignment so as to enable a color/black-and-white mixing operation to be performed. When sheets are stacked in the stacker 107, the control of stacking using the lifter device may be omitted, and instead, the output sheets from the color MFP 104 may be stacked naturally as they are.

Next, the construction of the inserter 108 will be described with reference to FIG. 18. The inserter 108 performs color/black-and-white mixing by feeding and conveying color output sheets, which have been outputted from the color MFP 104 and stacked and stored in the stacker tray 1207, in accordance with the insertion information in the storage device 1202 mentioned above so as to insert the color output sheets between black-and-white output sheets that are outputted from the black-and-white MFP 105. The inserter 108 is characterized by using the stacker tray 1207 as a means for stacking and storing color output sheets in advance so that the color output sheets to be inserted can be mixed with black-and-white output sheets.

Control is provided so as to raise the color output sheets stored in the stacker tray 1207 in the inserter 108 using the lifter section 1203 of the stacker tray 1207, as is the case with a stacker tray 1207 in the stacker 107 described above, so as to keep the height of the sheet surface constant with respect to the paper feeding roller 1903. In addition, a mechanism including a multiple feeding prevention roller 1904 is used that prevents a plurality of sheets from being simultaneously fed by rotating the roller 1904 in a reverse direction to the paper feeding roller 1903.

Next, the construction of the large-capacity stacker 109 will be schematically described with reference to FIG. 18. A bundle of sheets for a job (job bundle) that are stacked in the stacker tray 1207 in the inserter 108 and a bundle of sheets for the job (job bundle) that have been outputted from the black-and-white MFP 105 are mixed together as appropriate by the control described above and the mixed job bundles are successively stored in the large-capacity stacker 109 that is attached to a downstream side of the inserter 108. A group of job bundles that have thus been stacked in the large-capacity stacker 109 are thereafter subjected to processing such as binding and finishing in an offline manner.

The mechanism for performing the finishing processing includes a stapler for binding, a Z-shaped folding device for folding sheets in a Z-shape, a puncher for punching two (or three) holes for filing, etc. and the mechanism carries out such processing according to the type of a job to be performed. Other binding methods may include glue binding for booking, and trimming, such as cutting side edges of the sheets after binding opposite to the bound side edges to align the opposite side edges. A construction is more effective that the stacker tray 1207 described above also serves as a sheet storage means of the large-capacity stacker 109.

Next, the separation of a job into color image printing and black-and-white image printing will be described with reference to FIG. 14. When the color MFP 104 is used from the server computer 102 or the client computer 103 to perform printing based on a job in which color image pages and black-and-white image pages are mixed, first a driver, which is software running on the server computer 102 or the client computer 103, is used to transfer the job to the color MFP 104.

Figure 14:
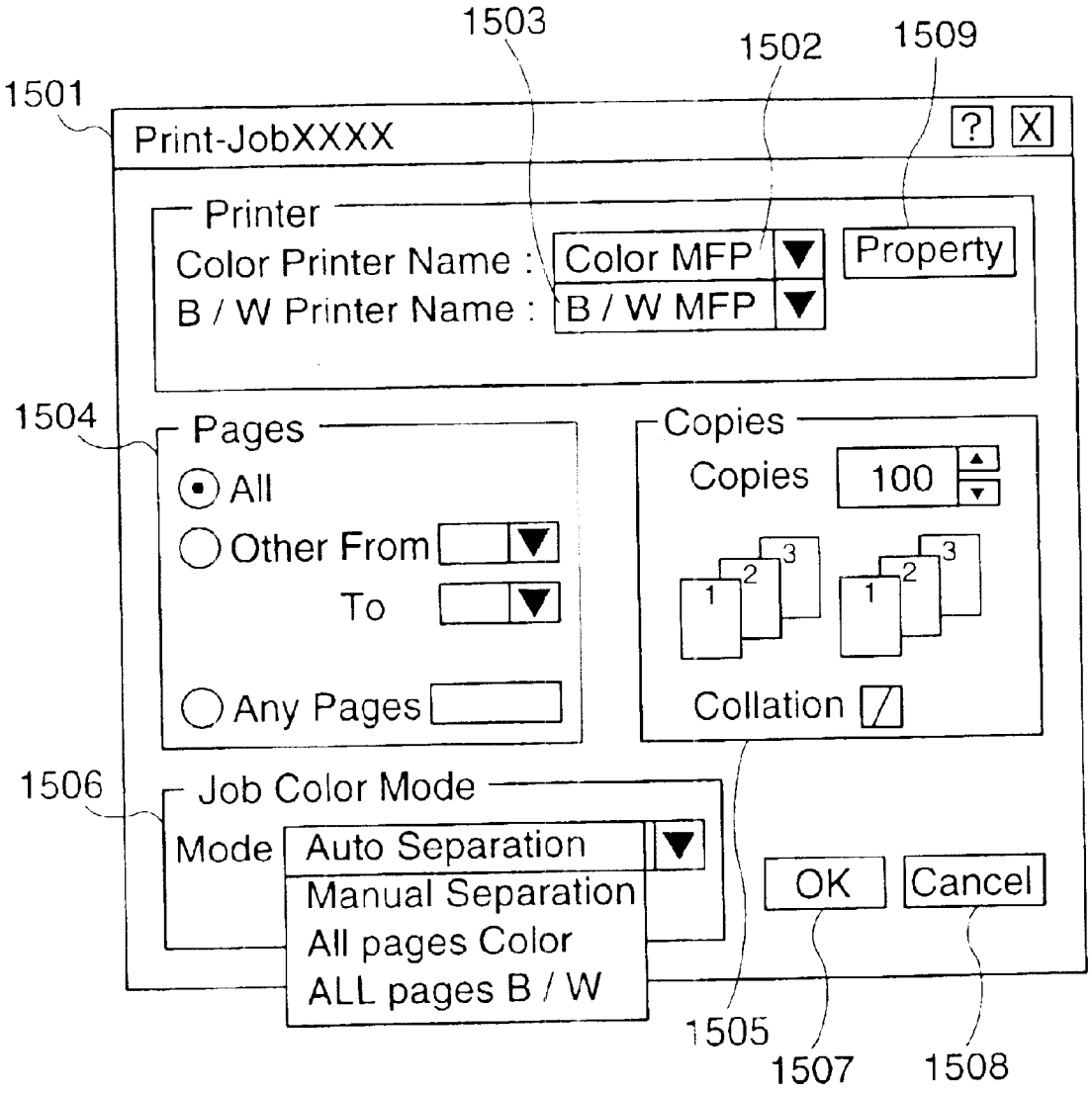
FIG. 14 is a diagram showing another example of the screen according to utility software executed by the server computer 102 or the client computer 103.

In FIG. 14, reference numeral 1501 denotes a driver window that is displayed on a screen of the server computer 102 or the client computer 103, with setting items in this driver being as follows. Reference numeral 1502 denotes a color printer selection column for selecting a color printer (the color MFP 104). Reference numeral 1503 denotes a black-and-white printer selection column for selecting a black-and-white printer (the black-and-white MFP 105). Reference numeral 1504 denotes a page setting column for selecting output pages in the job. Reference numeral 1505 denotes a number-of-copies setting column for setting the number of copies. Reference numeral 1506 denotes a job color mode column for instructing the separation of a color/black-and-white mixed job into printing of color image pages and printing of black-and-white image pages. Reference numeral 1507 denotes an "OK" key for starting printing. Reference numeral 1508 denotes a "Cancel" key for canceling printing. Reference numeral 1509 denotes a property key for performing more detailed settings.

Here, the job color mode column 1506 can be used to select one mode from "Auto Separation", "Manual Separation", "All Pages Color", and "All Pages B/W", and when manual separation is selected, the user selects which of the color MFP 104 and the black-and-white MFP 105 is to output each of the pages. That is, a manual setting is made in advance in a detailed setting window as to whether each page is color or black-and-white.

Figure 15:
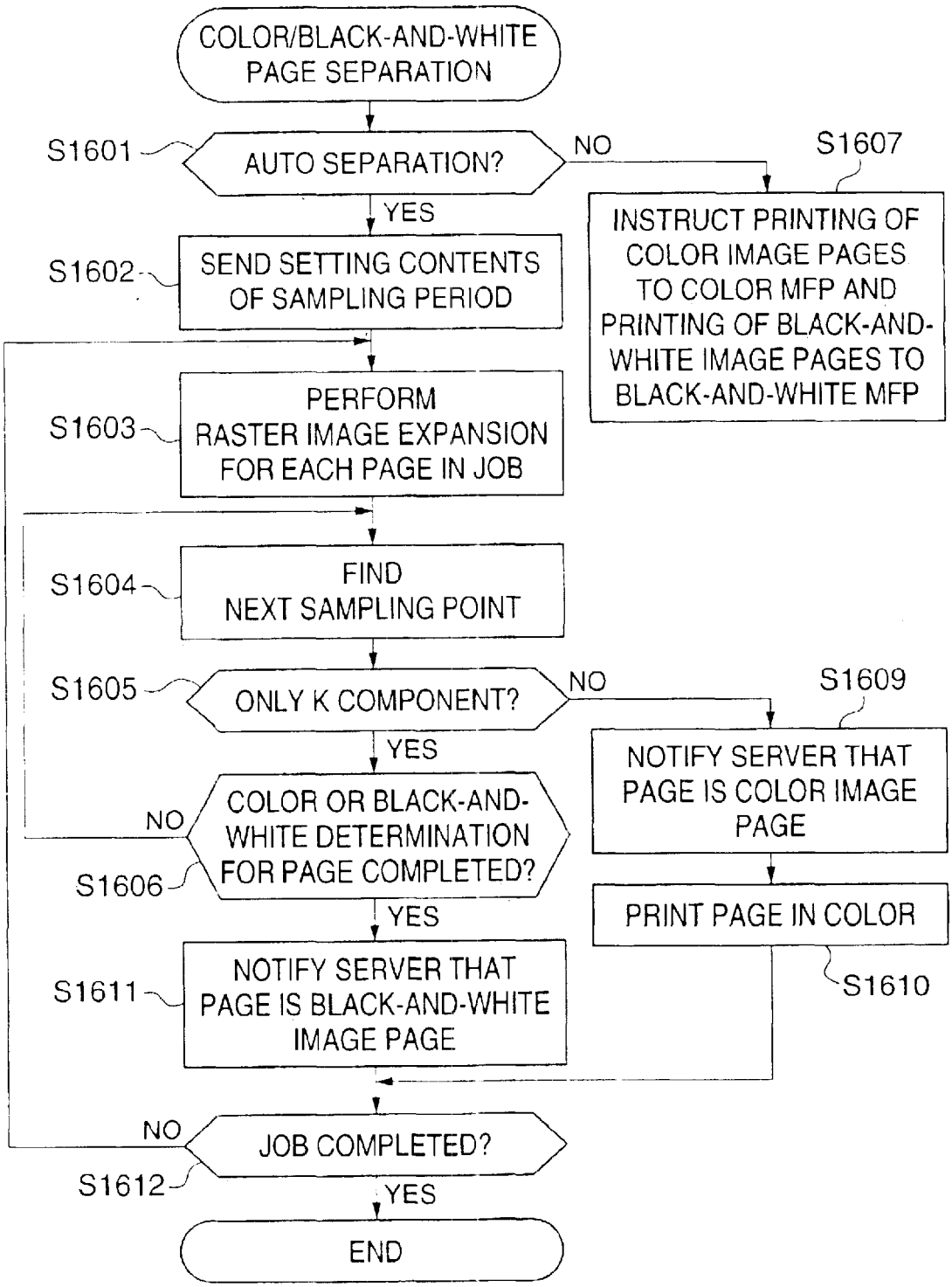
FIG. 15 is a flowchart showing a color/black-and-white image page separation process.

Next, a color/black-and-white image page separation process by the auto separation of a job will be described with reference to the flowchart in FIG. 15. In the driver window 1501 in FIG. 14 described above, when the "OK" key 1507 is pressed, the driver running on the client computer 103 sends a print job and information indicating that the job is a job in which color image pages and black-and-white image pages are mixed, via the server computer 102 to the color MFP 104 and the black-and-white MFP 105. In the case of auto separation, it has not been determined at this time point which pages are black-and-white image pages, so that the contents of all the pages in the job are sent to both the color MFP 104 and the black-and-white MFP 105. Here, the order of sending the color image pages and black-and-white image pages may be such that the pages are sent to the color MFP 104 first and then to the black-and-white MFP 105 a certain time period later, or the pages may be sent to the color MFP 104 and the black-and-white MFP 105 simultaneously.

The black-and-white MFP 105 that has received information indicating that color image pages and black-and-white image pages are mixed in the job does not start the printing immediately and instead waits for a notification of the black-and-white image page numbers from the color MFP 104. If auto separation is set for the job, ("YES" in step S1601), the setting contents of a sampling period is sent to the color MFP 104 (step S1602). The setting of the sampling period is performed in advance in the window for detailed settings that is displayed by the "Property" key 1509.

With regard to the sampling period, if sampling is performed at a rate of one point per an area of 100 pixels by 100 lines, the sampling time can be reduced to 1/10,000. In the case of a 400 dpi image, if sampling is performed in units of a lattice with intervals of 0.25 inches (=6.35 mm), depending upon whether the number of the sampled lattice points is less than a predetermined value (e.g. 1,500) or not on a sheet of a letter size (11" by 8.5"), it is possible to determine to a certain extent whether the image is black-and-white or color. Alternatively, for images where the determination is difficult, the sampling period can be set finer, or "Manual Separation" may be set in the job color mode column 1506 so that each page can be manually set as color or as black-and-white in advance in the detail setting window.

Next, the PDL section 205 of the color MFP 104 that has received the job and the setting contents of the sampling period performs successive raster image expansion processing (RIP) for each page in order starting from the last page in the job and stores the images after the RIP in the semiconductor memory 605 for each page and each color component (CMYK) (step S1603). The CPU 603 determines whether the stored images are color or black-and-white. This determination of color or black-and-white is made according to whether there are any components (CMY components) other from black (K) at the sampling points in the semiconductor memory 605 (steps S1604, S1605).

At this time, to increase the processing speed, if one color (CMY) component is found at any of the sampling points in a page ("NO" in step S1605), this means that the page has a color image so that the color/black-and-white determination for the page is stopped as soon as a color component is found and this page is processed as a color image page inside the color MFP 104. Also, in view of the possibility that the present job is reprinted, the server computer 102 is notified via the network 101 of page number information for this page and information indicating that this page is a color image page (step S1609). Next, the page is printed in color by the color MFP 104 (step S1610). Also, the page numbers of the color image pages in the job are stored in a memory of the color MFP 104 for writing into a memory, described later.

When there is not even a single color (CMY) component among the sampling points in the page ("YES" in step S1605, "YES" in step S1606), the page is to be processed a black-and-white image page, and hence the server computer 102 is notified via the network 101 of the page number information for the page and information indicating that the page is a black-and-white image page so that the page can be subjected to black-and-white processing as a black-and-white image page (step S1611). At the same time, the page number information is written into the memory of the color MFP 104 as page information. The server computer 102 may automatically inform the black-and-white MFP 105 of the black-and-white image page number information or may inform the black-and-white MFP 105 of the black-and-white image page number information in response to a request signal from the black-and-white MFP 105.

When the stacker tray 1207, in which sheets that have been recorded in color, has been correctly set in the inserter 108 that is attached to the black-and-white MFP 105, the black-and-white MFP 105 that has received the notification in step S1611 described above starts a color/black-and-white mixing operation for the sheets that have been printed by the black-and-white MFP 105 and the sheets that are stacked in the stacker tray 1207. After this, based on the information read from the storage device 1202 provided on the stacker tray 1207, RIP is performed to print only a corresponding black-and-white image page. So long as a job cancel interrupt does not occur during execution of steps S1603 to S1606 and during execution of steps S1609 to S1612, this operation is repeated until the last page, and the job is completed in the color MFP 104.

When auto separation has not been set for the job, that is, when manual separation has been set ("NO" in step S1601), the server computer 102 receives information on whether each individual page is black-and-white or color from the driver, and in accordance with this information instructs the color MFP 104 to print only the color image pages and the black-and-white MFP 105 to print only the black-and-white image pages (step S1607). The color MFP 104 then prints the color image pages and the black-and-white MFP 105 prints the black-and-white image pages in predetermined timing.

In the above described manner, jobs in which color image pages and black-and-white image pages are mixed can be processed by having the color image pages printed by the color MFP 104 and the black-and-white image pages printed by the black-and-white MFP 105.

Although in the above explanation, he RIP is sequentially performed one page at a time in order, the RIP may be performed for an entire job in the large-capacity memory (HDD) 604 and then one or a plurality of pages may be read out onto the semiconductor memory and the determination process then performed. Although in the above explanation, auto separation of a job separates the pages into color image pages and black-and-white image pages, such separation may be performed in units of a predetermined number of copies or may separate the pages into photograph pages and text pages. Although in the above explanation, print information from the driver is sent to the color MFP 104, the determination of color or black-and-white is performed for each page by the color MFP 104, and the output of the color image pages is started first, this is not limitative to the present invention and the determination of color or black-and-white may be performed by the black-and-white MFP 105 and the output of the black-and-white image pages may be performed first.

Next, read and write operations for the storage device 1202 will be described with reference to FIGS. 16 and 17. When the color MFP 104 prints and outputs a color job for color/black-and-white mixing to the stacker tray 1207, as shown in FIG. 17, a CPU 1805 of the color MFP 104 performs a write operation for the storage device 1202 provided on the stacker tray 1207 in the stacker 107. The CPU 1805 of the color MFP 104 performs a write operation into the storage device 1202. Specifically, the CPU 1805 of the color MFP 104 performs a write operation into the storage device 1202 via an interface section 1803 of the color MFP 104 and an interface section 1804 of the stacker tray 1207 for all of the information that is required for a color/black-and-white mixing operation, such as the sheet size, number of pages, number of copies, printer number, job number, page numbers resulting from a color/black-and-white determination, page order information ("S-placing mode" or "F-placing mode", etc.), material, and information on the finishing process. The stacker tray 1207 is also provided with a display section 1210 and a battery 1211.

Figure 16:
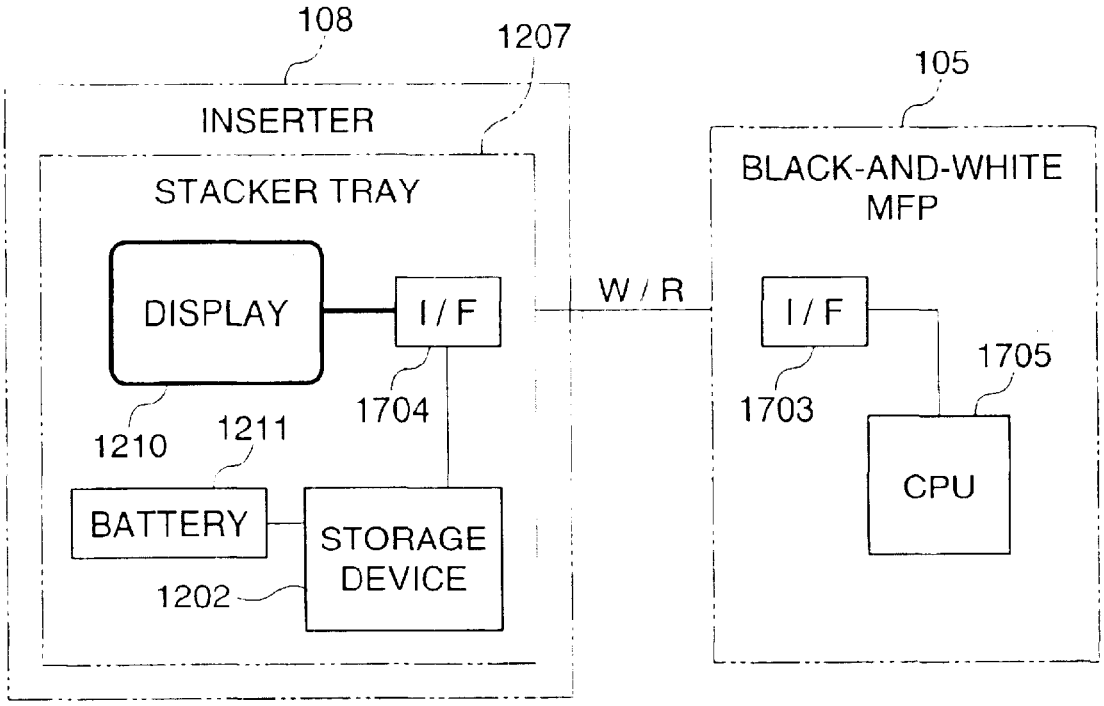
FIG. 16 is a diagram useful in explaining a read operation for a storage device 1202 of an inserter 108 of the black-and-white MFP 105 shown in FIG. 1.
Figure 17:
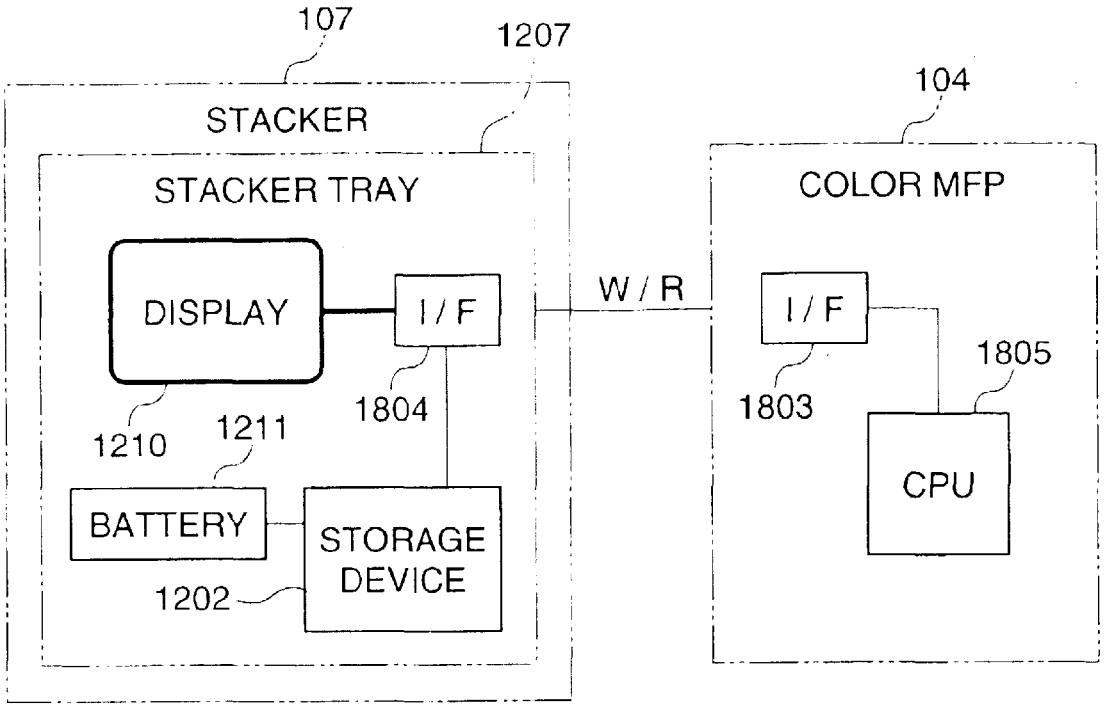
FIG. 17 is a diagram useful in explaining a write operation for the storage device 1202 of a stacker 107 of the color MFP 104 shown in FIG. 1.

As shown in FIG. 16, when a CPU 1705 of the black-and-white MFP 105 subsequently detects the attachment of the stacker tray 1207 to the inserter 108 of the black-and-white MFP 105 via a stacker tray presence sensor, not shown, a read operation for information in the storage device 1202 is performed via an interface section 1703 of the color MFP 104 and an interface section 1704 of the stacker tray 1207. Then, based on this read information, the black-and-white MFP 105 and the inserter 108 are controlled to start the color/black-and-white mixing operation.

The interface section of each of the color MFP 104, the black-and-white MFP 105, and the stacker tray 1207 may be controlled in parallel via a bus having a bus width of multiple bits, and by providing a serial control section in each interface section, the control may be performed by serial communication, such as infra red communication. Further, when the black-and-white MFP 105 prints and outputs sheets to the stacker tray 1207, the CPU 1705 of the black-and-white MFP 105 performs a write operation for the same kinds of information as above into the storage device 1202 of the stacker tray 1207. A similar read operation to that described above may be performed in the color MFP 104.

The storage device 1202 can also have a map of data for a plurality of jobs, so that color/black-and-white mixing operations for a plurality of jobs can be handled by a single stacker tray. Further, the information written in the storage device 1202 is protected from data loss by using a nonvolatile memory such as EEPROM as the storage medium or alternatively, in the case where a SRAM is used as the storage medium, by controlling the supply of power by the battery 1211 the information written in the storage device 1202 is protected from data loss even when the stacker tray 1207 is detached from the stacker 107 or the inserter 108 so that power is not supplied from the color MFP 104 or the black-and-white MFP 105.

Next, the construction of the memory map of the storage device 1202 will be described with reference to FIG. 19. In the memory map shown in FIG. 19, job numbers, printer numbers, etc. are assigned to addresses as illustrated. When a plurality of jobs are written, they are assigned to areas 0 to "n". Using the illustrated map as an example, there are a plurality of jobs that have been stacked in the stacker tray 1207 and the number of a job that is to be processed first is a job number "JOB3". The inserter 108 in which the stacker tray 1207 is to be set is connected to the black-and-white MFP 105, a determination is made as to whether the combination of the printer number of this black-and-white MFP 105 and the above-mentioned job number is a desired combination, and only when it is the desired combination, and hence the job corresponding to the job number should be printed, a color/black-and-white mixing operation is performed. When the above combination is not the, desired combination, the client computer 103 is notified by the server computer 102 of information indicating this situation, or notification is performed via the display section or the like of the black-and-white MFP 105. When the printer number is not specified, this shows that any black-and-white MFP to which the inserter 108 has been attached can be used.

The illustrated map shows that the priority level of the job related to the sheets stacked in the stacker tray 1207 is "L1". Further, the map shows that the sheet size is "A4" and the material of the stacked sheets is "thick paper", so that processing unique to thick paper should be performed, such as control that variably controls the sheet feeding speed. Stacking information shows "state A" meaning that the stacking state inside the stacker tray 1207 is that a job bundle has been outputted by a black-and-white MFP 105 face down from the first page onwards (the sheets have been outputted with the image formation surface facing downwards) and that face up output (output in a state where the image formation surface faces upwards) is required by a color MFP, so that print control is performed in accordance with this state "A". Also, the page numbers that need to be printed in black and white are indicated as "3.4.5.10.12 . . . ", so that a print operation is performed for these pages only.

Next, an outline of the color/black-and-white mixing of a job will be described with reference to FIG. 1. When a sheet bundle has been printed by the color MFP 104 and discharged to the stacker 107, the user sets the entire stacker tray 1207 with the stacked sheet bundle in the inserter 108 that is connected to the black-and-white MFP 105. When the black-and-white MFP 105 detects that the stacker tray 1207 has been set, it reads out the storage information of the storage device 1202 inside the stacker tray 1207 and determines from information such as the job number, etc. in the read information, whether the job is to be mixed, and when it is determined that the job is to be mixed, the controller of the black-and-white MFP 105 activates the server computer 102 or the client computer 103 to receive the job information from the server computer 102.

The black-and-white MFP 105 mixes the color output sheets into the black-and-white output sheets in accordance with the job information and identifies in what page position the color output sheets and black-and-white output sheets should be disposed and what kind of finishing process should be performed. Alternatively, without activating the server computer 102 or the client computer 103, color/black-and-white mixing may be performed in accordance with print information that has been downloaded in advance into the main body of the black-and-white MFP 105. By recognizing the material (type of sheets) of the color output sheets to be mixed, control may be performed so as to vary sheet feeding speed and/or conveying speed.

In the case where, due to a cause called jamming or "multiple feeding" in the color MFP 104, improper sheets are stored in the stacker tray 1207, such sheets may be forcibly discharged into an escape tray by reading information on a job number for which it is determined that color/black-and-white mixing should not be performed and sheet numbers that cannot be used from the storage device 1202 of the stacker tray 1207. It is also effective to inform the user of such information using a communication means such as a display section.

Next, a description will be given of how the output method for black-and-white output sheets of the black-and-white MFP 105 is controlled according to the stacking method for the color output sheets that are stored in the stacker tray 1207, with reference to FIG. 20. When the sheets outputted from the color MFP 104 have been outputted face up and processed starting with the last page, the output bundle that is stacked inside the stacker tray 1207 is disposed as shown by "A-1" in FIG. 20. In this case, after the color/black-and-white mixing, the face down output of sheets as shown by "A-2" in FIG. 20 is required, so that processing for face down output starting with the page is selected for the output from the black-and-white MFP 105.

Figure 20:
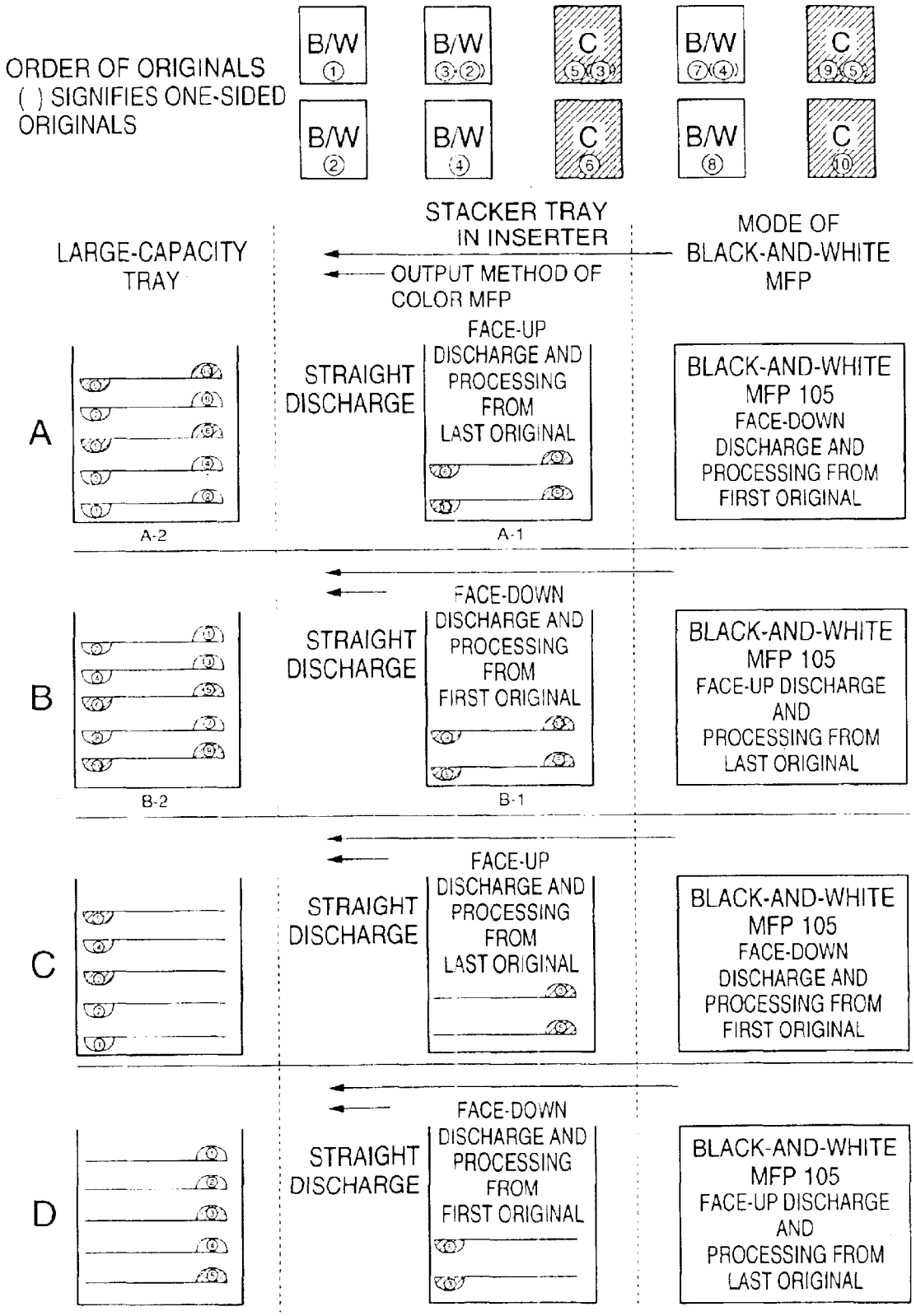
FIG. 20 is a diagram showing how an output method of outputting black-and-white output images from the black-and-white MFP 105 is controlled according to a stacking method of stacking color output sheets stored in a stacker tray 1207.

In the same way, when the output from the color MFP 104 has been face down output and processed starting from the first page, the output bundle stacked in the stacker tray 1207 is disposed as shown by "B-1" in FIG. 20. In this case, after the color/black-and-white mixing, a face up output of sheets as shown by "B-2" in FIG. 20 is required, so that processing for face up output starting with the last page is selected for the output from the black-and-white MFP 105.

Therefore, it is necessary to control the image formation processing of the black-and-white MFP 105 in accordance with the stacking method of the color output sheets of the color MFP 104, and information related to such control is stored in the storage device 1202 of the stacker tray 1207. The color MFP 104 performs the color/black-and-white mixing operation based on this information.

Figure 21:
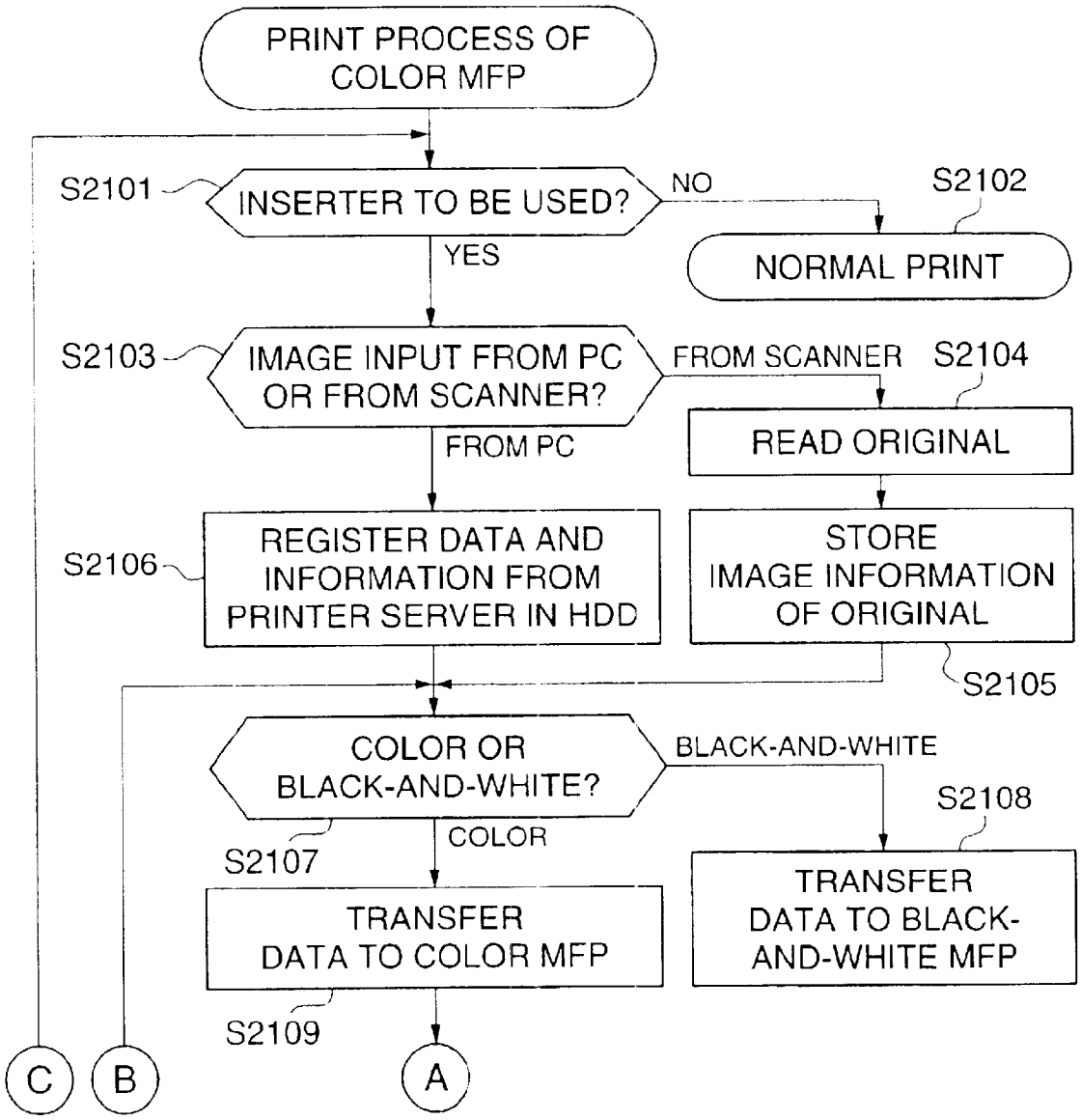
FIG. 21 is a flowchart showing a print process carried out by the color MFP 104.
Figure 22:
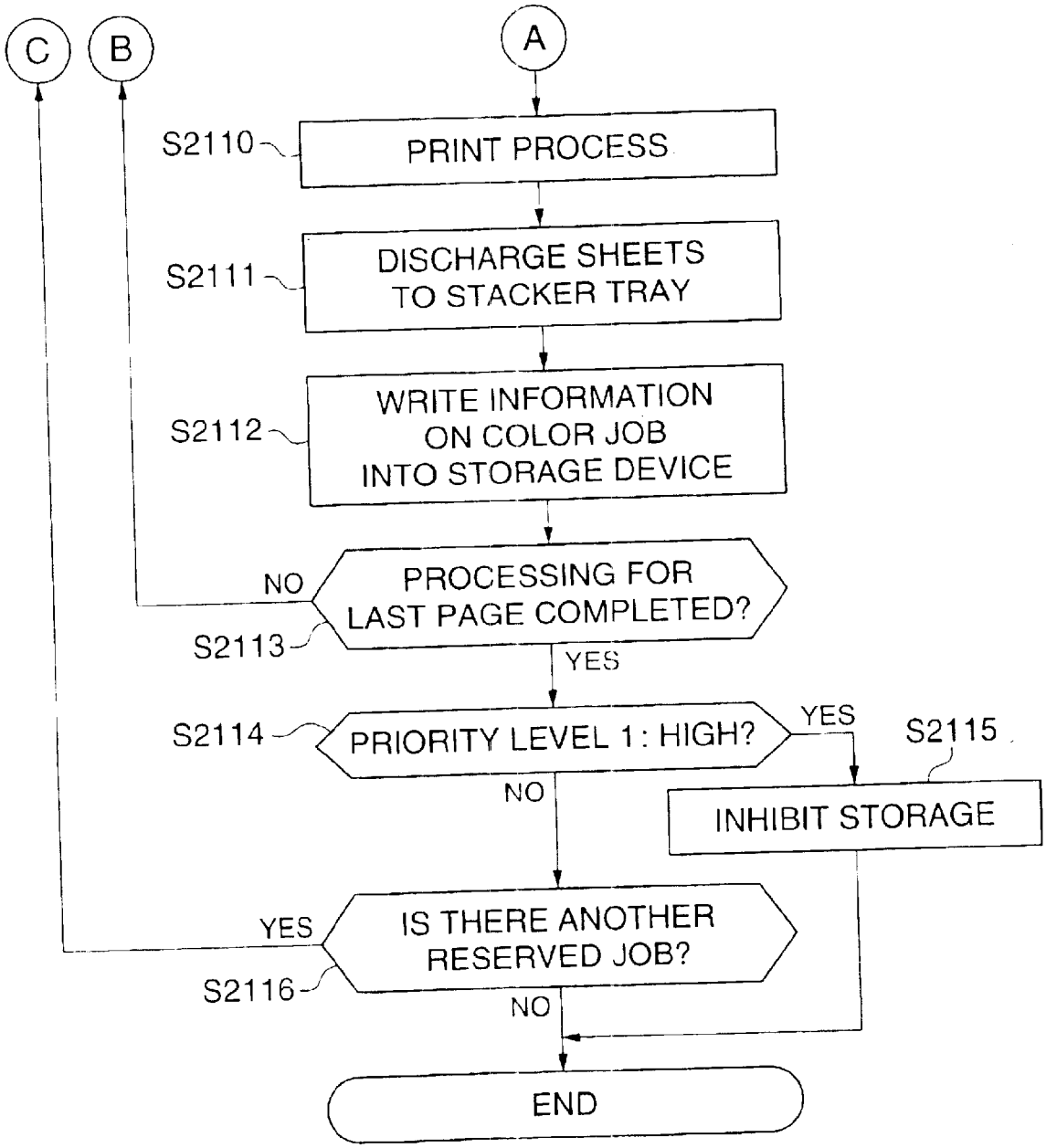
FIG. 22 is a flowchart showing a continued part of the print process of FIG. 21.

Next, the print process of the color MFP 104 will be described with reference to flowcharts in FIGS. 21 and 22. The print process of FIGS. 21 and 22 is executed by the CPU 1805 inside the color MFP 104 according to a program stored on a storage medium that is connected to the CPU 1805.

In this case, it is assumed that the inserter 108 is attached to the color MFP 104. By setting a job in a setting screen of a PC (the server computer 102) or on the operating part of the color MFP 104, the CPU 1805 of the color MFP 104 determines whether to use the inserter 108 to mix color sheets and black-and-white sheets (step S2101). When the CPU 1805 of the color MFP 104 determines not to use the inserter 108, processing is performed in accordance with the control described above as normal printing (step S2102). When the CPU 1805 of the color MFP 104 determines to use the inserter 108, it is determined whether the image data input method is a method that inputs image data by reading an original using the scanner section 201 or a method that inputs electronic file data from a PC (the server computer 102) (step S2103).

When the CPU 1805 of the color MFP 104 determines that the image data input method is the method that inputs image data by reading an original using the scanner section 201, it causes the scanner section 201 to read an original that has been placed on the platen and is pressed by a pressing plate or an original that has been fed by an automatic original feeding apparatus (step S2104), converts the resulting data into digital image information, and stores in an image storage device, such as a hard disk drive, inside the color MFP 104 (step S2105). When the CPU 1805 of the color MFP 104 determines that the image data input method is the method that inputs electronic file data from the PC (the server computer 102), downloads image information and various kinds of setting information into the color MFP 104 from the server computer 102 and registers the image information and various kinds of setting information (setting information of a job, etc.) as they are in an image storage device such as a hard disk drive (step S2106).

Then, the CPU 1805 of the color MFP 104 determines whether the image of a page to be formed that has been stored in the image storage device inside the color MFP 104 is a color image or a black-and-white image (step S2107). When the CPU 1805 of the color MFP 104 determines that the page is a black-and-white image page ("black-and-white" in step S2107), it writes order information (page information) etc. thereof onto the memory map in the storage device 1202 of the stacker tray 1207. The CPU 1805 of the color MFP 104 transfers black-and-white data out of the data stored in the image storage device inside the color MFP 104 either to an image storage device of the server computer 102 or via the server computer 102 to an image storage device of the black-and-white MFP 105 (step S2108). Since it is sufficient to send data showing which pages out of the job data are black-and-white image data as the transferred data, the image data itself does not need to be sent.

When the CPU 1805 of the color MFP 104 determines that the page is a color image page ("color" in step S2107), it transfers the color data to the image storage device in the color MFP 104 (step S2109). Then, the CPU 1805 of the color MFP 104 selects whether processing is to be performed from the first page or from the last page according to a stacking method that has been set or a stacking method that is automatically determined, and thereafter causes the printer section 208 to perform a print process (step S2110). Color output sheets are then stacked into the stacker tray 1207 inside the inserter 108 (step S2111). At this time, the CPU 1805 of the color MFP 104 writes information for mixing the color sheets, such as the information shown in the memory map of FIG. 19 described above, into the storage device 1202 inside the stacker tray 1207 (step S2112). Then, if the processing for the last page has not been completed ("NO" in step S2113), the process returns to step S2107 to continue the process, while if the processing for the last page has been completed ("YES" in step S2113), the present process is terminated.

Although information is written into the storage device 1202 of the stacker tray 1207 once for each sheet in the present embodiment, this is not limitative to the present invention and the write timing may be anytime, such as before execution of a job, once for each job, once for each page, or after execution of each job.

Figure 26A:
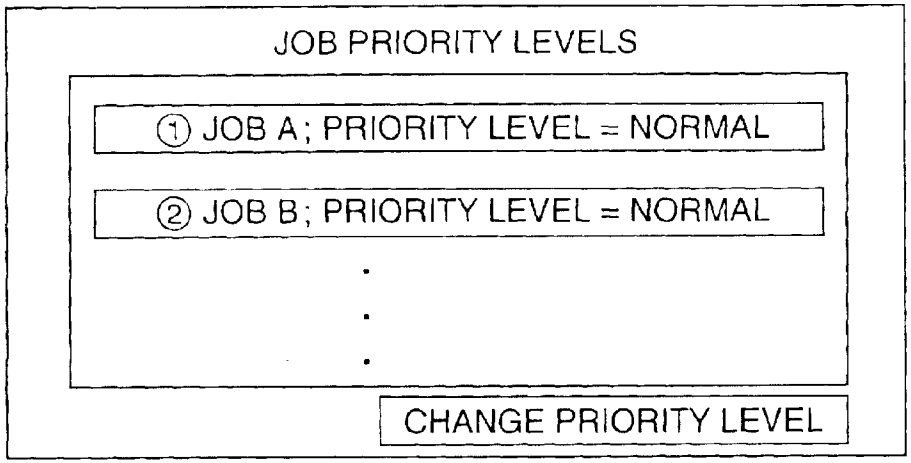
Figure 26B:
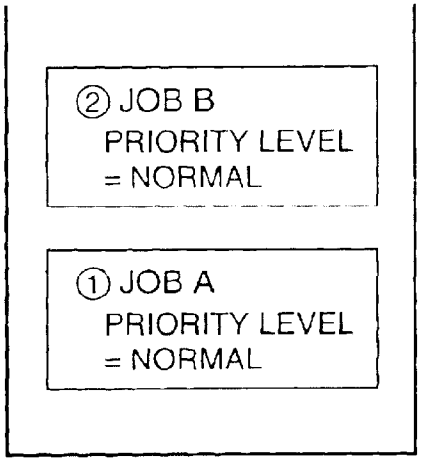
Figure 26C:
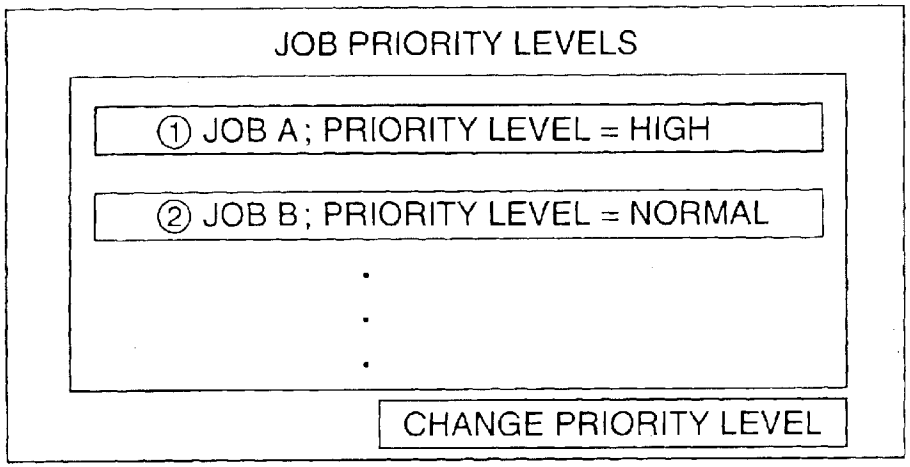
Figure 26D:
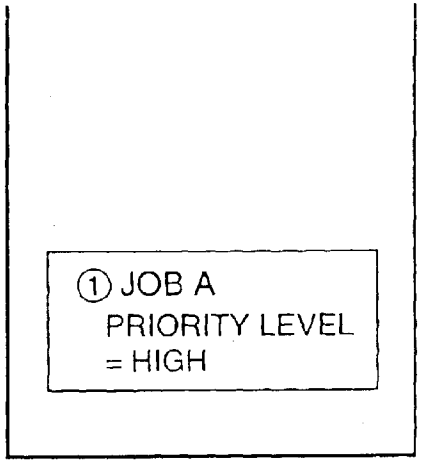
Figure 27:
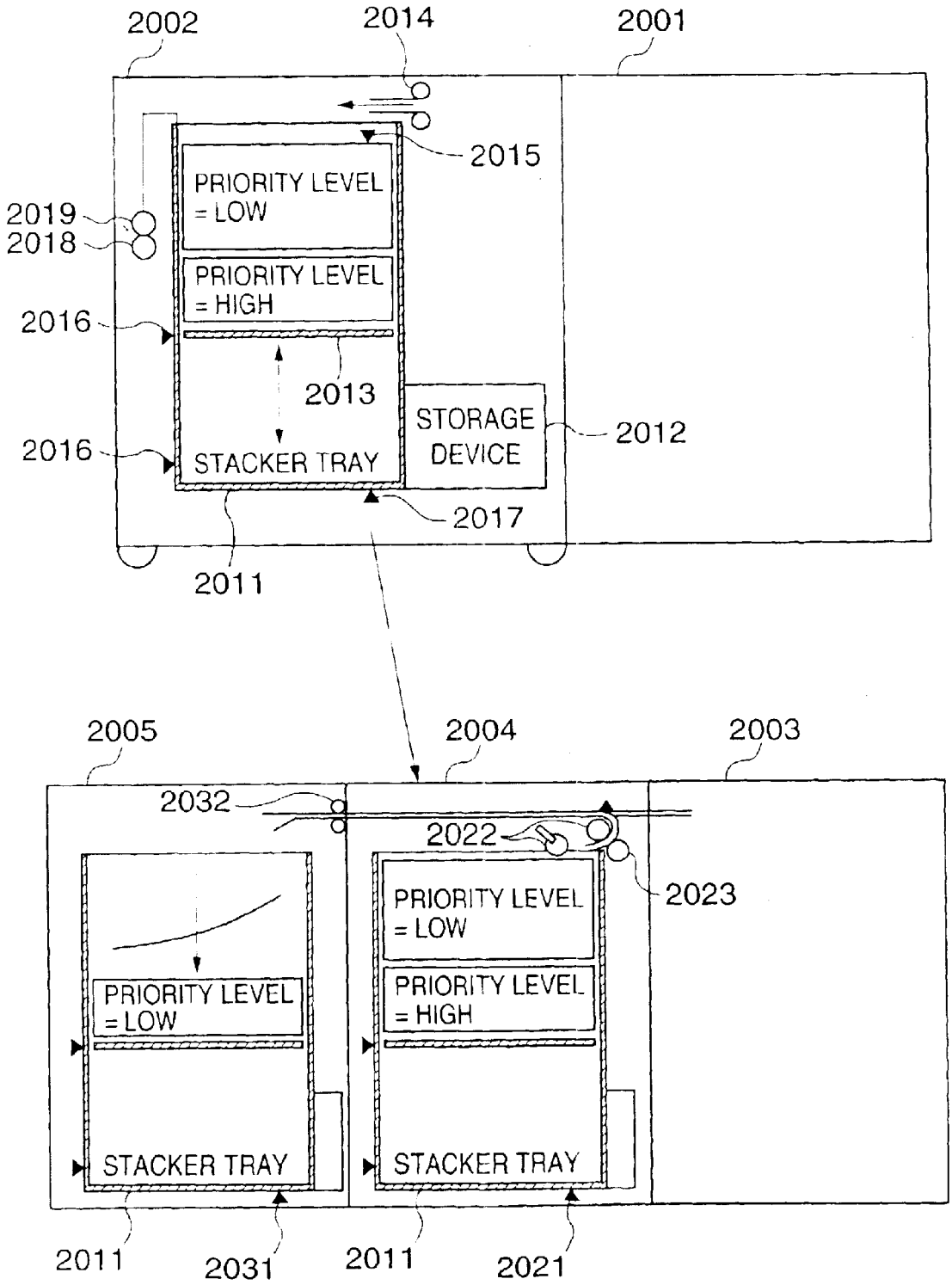
FIG. 27 is a schematic diagram showing a conventional image forming system comprised of a color MFP 2001 and a black-and-white MFP 2003.

Next, a process for setting priority levels and changing the settings of the priority levels displayed in the operating part will be described with reference to FIGS. 26A to 26D. When priority levels of job A and job B are set to be "normal" according to settings of the server computer 102 (see FIG. 26A), output sheets are outputted to the stacker tray 1207 in a stacking state shown in FIG. 26B. However, when the priority level of job A is set to be "high" and that of job B "normal" according to the settings of the server computer 102 (see FIG. 26C), the stacking of job B is inhibited and the stacking state of output sheets in the stacker tray 1207 is as shown in FIG. 26D. Also, when the priority levels are changed using a priority changing key of the operation part such that the priority of job A becomes "high", the stacking state is also as shown in FIG. 26D.

When the CPU 1805 of the color MFP 104 determines that the priority level of a job that has been set by the server computer 102 or the operation part (priority setting means) of the color MFP 104 is "high" ("YES" in step S2114 in FIG. 22), the storage of sheets for subsequent jobs in the stacker tray 1207 is inhibited, that is, image formation for the subsequent jobs is postponed (see FIG. 25), and the processing of the color MFP 104 is terminated (step S2115). When the CPU 1805 of the color MFP 104 determines that the set priority level of the job described above is "normal" ("NO" in step S2114), the process proceeds to step S2116. When the CPU 1805 of the color MFP 104 determines that the next job has been reserved at that time ("YES" in step S2116), the CPU 1805 determines whether to stack output sheets in the same stacker tray 1207 in accordance with a user instruction when such an instruction has been given, or continues the storage processing without interruption when no user instruction has been given, that is, the processing in steps S2101 to S2116 is repeated.

Figure 25:
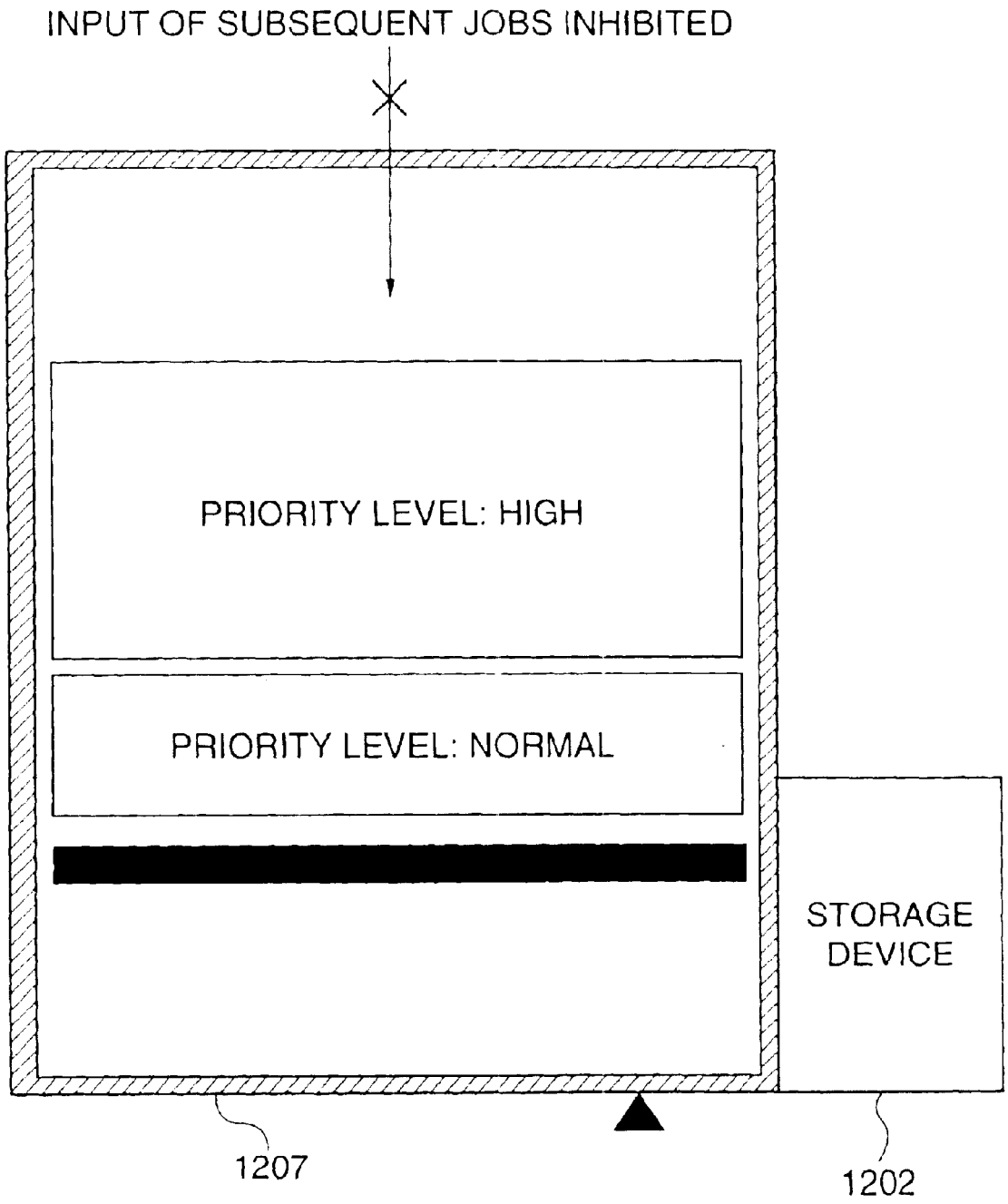
FIG. 25 shows a storage inhibited state for output sheets in the stacker tray 1207 according to processing in step S2115 in FIG. 22.

As described above, when the priority level of the present job is set to be "high", as shown in FIG. 25, the stacking process for stacking subsequent output sheets in the stacker tray 1207 is inhibited. Consequently, when the stacker tray 1207 is removed from the stacker 107 of the color MFP 104 and is attached to the inserter 108 of the black-and-white MFP 105, it is possible to prevent the job with the high priority level from being processed after other jobs.

Here, although in the above example, the priority level is set by the user via the operation part of the image forming apparatus, the setting of priority level is not limited to this. For example, an ID may be assigned to a user who has inputted an image forming job and a priority level may be assigned to each user ID from a server or the image forming apparatus, with the server or a controller of the image forming apparatus determining and setting the priority level based on the user ID of a registered job.

In the case of a print system where the image formation of registered jobs is commenced in order of the proximity of output deadlines, when a new job that has a more urgent output deadline than presently registered jobs is inputted, the image forming apparatus or the server may determine that the priority level of this new job is "high".

Figure 23:
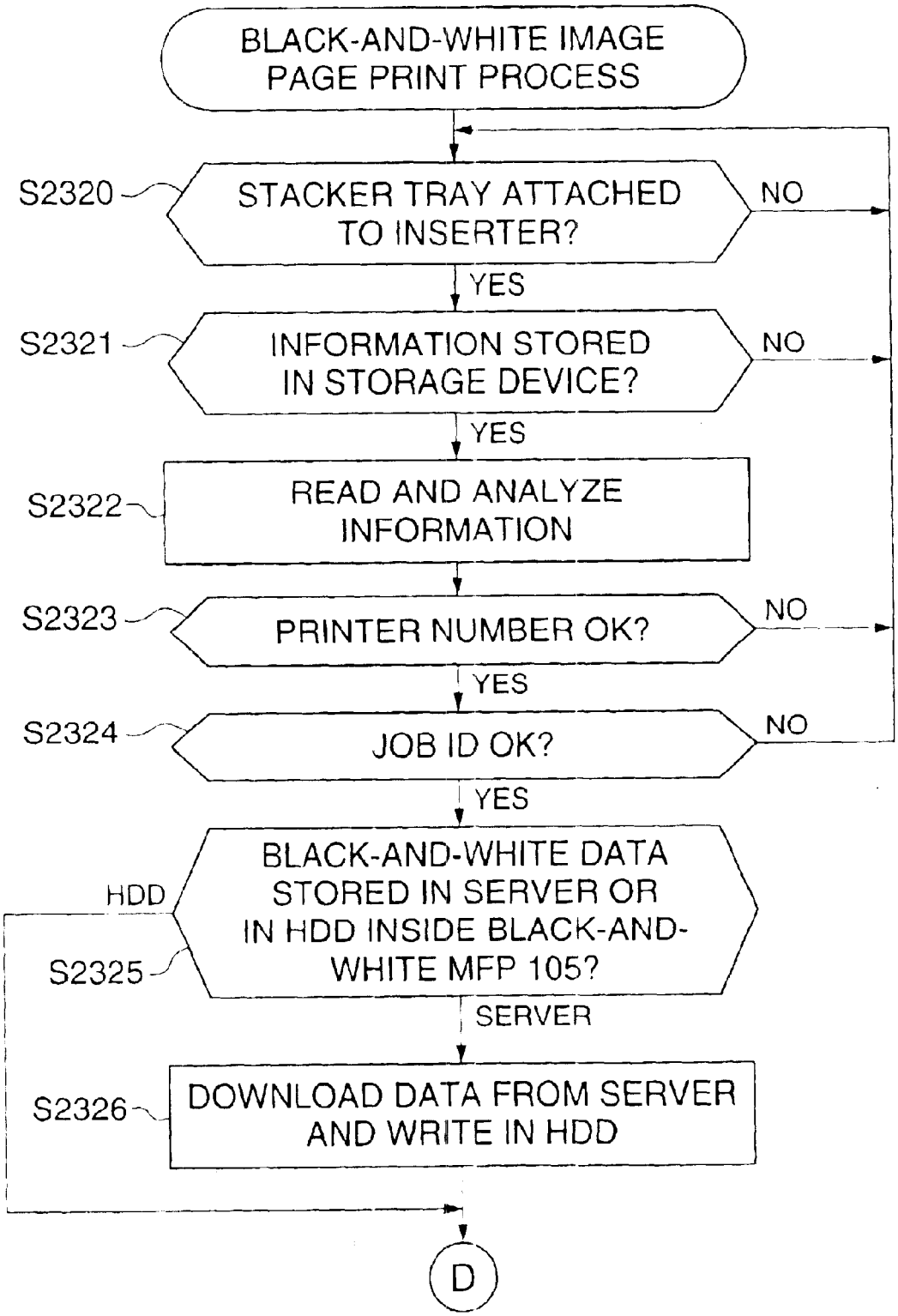
FIG. 23 is a flowchart showing a black-and-white image page print process carried out by the black-and-white MFP 105.
Figure 24:
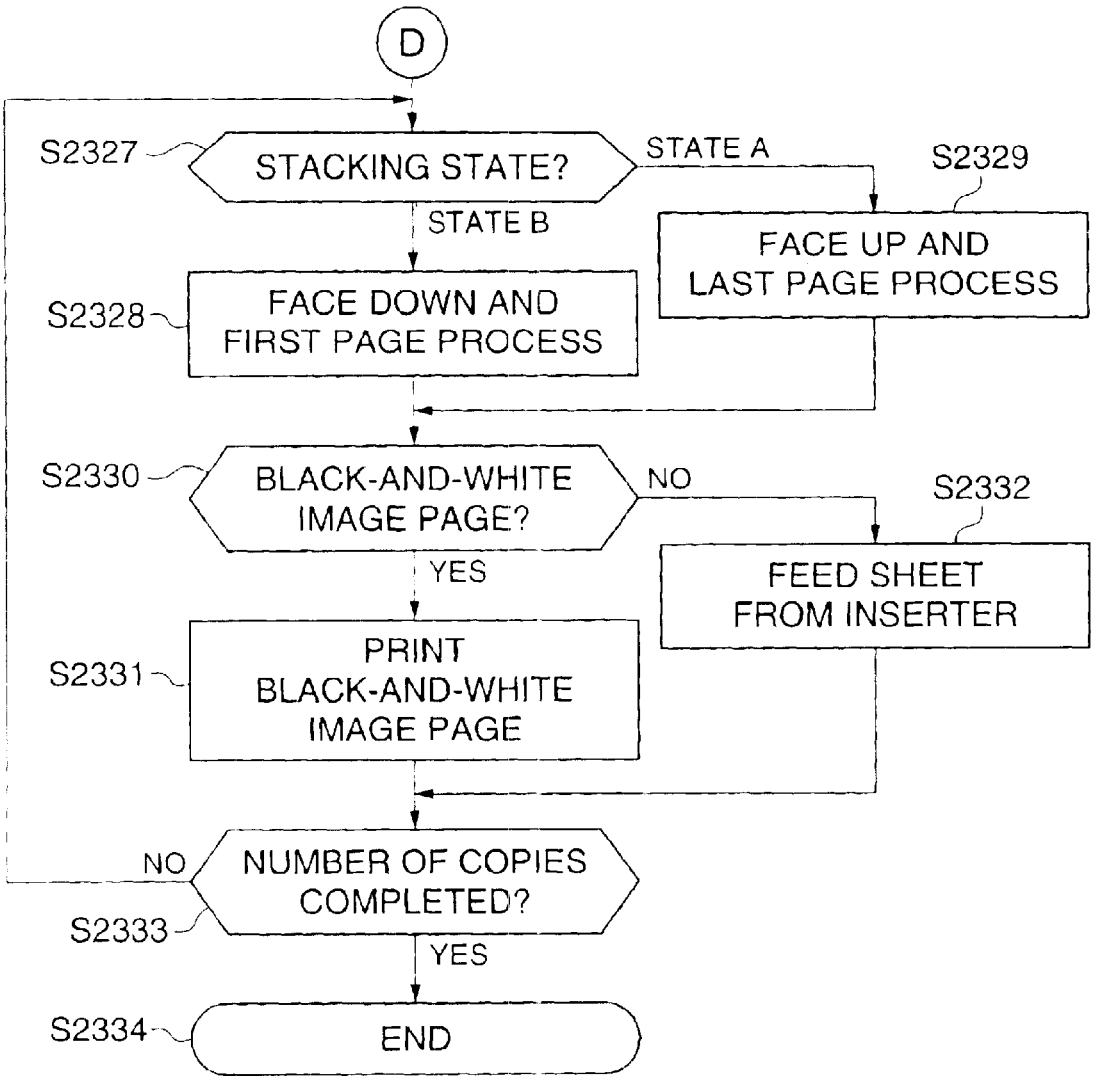
FIG. 24 is a flowchart showing a continued part of the black-and-white image page print process of FIG. 1.

Next, the black-and-white image page print process of the black-and-white MFP 105 will be described with reference to flowcharts in FIGS. 23 and 24. This print process is executed by the CPU 1705 inside the black-and-white MFP 105 according to a program stored in a storage medium that is connected to the CPU 1705.

Upon detecting, via the stacker tray presence detecting sensor 1201 (see FIG. 12), that the stacker tray 1207 has been attached to the inserter 108 that is attached to the black-and-white MFP 105 ("YES" in step S2320), the CPU 1705 of the black-and-white MFP 105 determines whether information for color/black-and-white mixing is stored in the storage device 1202 inside the stacker tray 1207 (step S2321). When it is determined that information for color/black-and-white mixing is stored, the CPU 1705 of the black-and-white MFP 105 reads and analyzes the information in the storage device 1202 (step S2322). Here, the CPU 1705 of the black-and-white MFP 105 performs the analysis based on the internal information in a memory map in the storage device 1202, such as that shown in FIG. 19 described above, and starts a print operation by the printer section 208.

First, the CPU 1705 of the black-and-white MFP 105 reads the "printer number", which shows the MFP (printer) that should mix the job bundles in the stacker tray 1207, from the storage device 1202 that is provided on the stacker tray 1207 and compares the read printer number with the apparatus information that is stored in a memory in the black-and-white MFP 105 (step S2323). When both pieces of information match, the CPU 1705 of the black-and-white MFP 105 reads the job ID to be processed first for the stacker tray 1207 from the storage device 1202 and determines whether a job corresponding to this job ID has been transmitted to the black-and-white MFP 105 (step S2324). When a matching job ID is present, the CPU 1705 of the black-and-white MFP 105 executes black-and-white printing by the printer section 208.

At this time, if the black-and-white data is in the server computer 102 ("SERVER" in step S2325), the CPU 1705 of the black-and-white MFP 105 downloads, from the server computer 102, the image data for the present job with the job ID and printer number written on the memory map in the storage device 1202 and stores the image data in the storage device 1202, which is an HDD or the like (step S2326). When the job ID and printer number do not match, the CPU 1705 of the black-and-white MFP 105 informs the user by displaying an indication showing that the information does not match via a display of the operating part or the like. By determining whether the job ID and the printer number match, it is possible to prevent print data other than the job specified by the user from being mixed in, and it becomes possible to perform color/black-and-white mixing operations using MFPs (printers) based on user requests.

When the image data has been stored in the hard disk drive inside the black-and-white MFP 105 in advance, the CPU 1705 of the black-and-white MFP 105 determines whether the job number and printer number match the image data in the hard disk drive, and when the job number and printer number do not match, informs the user via the display means of the operating part or the like. When the job number and printer number match, the CPU 1705 starts a print operation according to the color/black-and-white mixing control described above.

Then, the CPU 1705 of the black-and-white MFP 105 determines which of the patterns for the "stacking method" described above matches the stacked state, based on information on the stacking method that is stored in the storage device 1202 of the stacker tray 1207 (step S2327). When the stacked state is determined to be "state B", the CPU 1705 of the black-and-white MFP 105 executes face down output control according to a process starting from the first page (step S2328), while when the stacked state is determined to be "state A", the CPU 1705 of the black-and-white MFP 105 executes face up output control according to a process starting from the last page (step S2329).

Then, based on the memory map of the storage device 1202 or the page number information of the server computer 102, the CPU 1705 of the black-and-white MFP 105 determines whether the present page that is being processed by a mixing operation is a black-and-white image page or a color image page (step S2330). When it is determined that the present page being processed as a mixing operation is a black-and-white image page, the CPU 1705 of the black-and-white MFP 105 causes the printer section 208 to form a suitable image for the present page to output the black-and-white output sheet to the stacker tray 1207 of the large-capacity stacker 109 (step S2331). When it is determined that the present page being processed as a mixing operation is a color image page, the CPU 1705 of the black-and-white MFP 105 feeds the color output sheet corresponding to the present page from the stacker tray 1207 that is set in the inserter 108 to output the color output sheet to the stacker tray 1207 of the large-capacity stacker 109 (step S2332). By repeating the above operation for the set number of copies ("YES" in step S2333), the mixing operation for color output sheets and black-and-white output sheets is completed (step S2334). When sheets for a plurality of jobs are stored in the stacker tray 1207, the process from step S2320 to step S2333 is repeated for each of the stored jobs.

It should be noted that the information that is useful or necessary for a color/black-and-white mixing operation is not limited to the various kinds of information described above. Further, although in the present embodiment, color output sheets from the color MFP 104 are stacked in the stacker tray 1207 and are mixed at the inserter 108 that is attached to the black-and-white MFP 105, this is not limitative to the present invention, and for example, black-and-white output sheets from the black-and-white MFP 105 may be stacked in the stacker tray 1207 and mixed at the inserter 108 that is attached to the color MFP 104.

As described above, according to the present embodiment, when it is determined that the priority level of a job is "high", output sheets relating to jobs that follow the job is inhibited from being stored in the stacker tray 1207 so that when the stacker tray 1207 is attached to the inserter 108, other jobs are not processed before the job with the high priority level and the job with the high priority level can be outputted in a timely manner.

Although in the embodiment described above, an image forming system constructed as shown in FIG. 1 is given as an example, the present invention is not limited to this construction, and the numbers of image forming apparatuses (MFP), computers, other apparatuses (scanners, printers, facsimiles, etc.) may be freely chosen, and also the manner in which the stackers, inserters and large-capacity stackers are attached to the image forming apparatuses may be freely chosen.

Although in the embodiment described above, color/black-and-white mixing control is performed with an arrangement that stackers, inserters and large-capacity stackers are attached to image forming apparatuses (MFP), the present invention is not limited to this and color/black-and-white mixing control may be performed with an arrangement that stackers, inserters and large-capacity stackers are attached to other image forming apparatuses (printers, copiers, etc.).

Although in the embodiment described above, an electrophotographic method is used as the image forming method of the image forming apparatuses, the present invention is not limited to this and may be applied to other image forming methods, such as ink jet methods may be used.

The present invention may either be applied to a system composed of a plurality of apparatuses or to a single apparatus.

It is to be understood that the present invention may also be accomplished by supplying a system or an apparatus with a medium, such as a storage medium in which a program code of software which realizes the functions of the above described embodiment is stored, and causing a computer (or CPU or MPU) of the system or apparatus to read out and execute the program code stored in the storage medium.

In this case, the program code itself read out from the storage medium realizes the functions of the embodiment described above, and hence the storage medium on which the program code is stored constitutes the present invention.

Examples of the storage medium for supplying the program code include a floppy (registered trademark) disk, a hard disk, an optical disk, a magneto-optical disk, a CD-ROM, a CD-R, a CD-RW, a DVD-ROM, a DVD-RAM, a DVD−RW, a DVD+RW, a magnetic tape, a nonvolatile memory card, and a ROM. Downloading via a network may be used as the storage medium for supplying the program code.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the medium, such as a storage medium, into a memory provided in an expansion board inserted into a computer or in an expansion unit connected to the computer and then causing a CPU or the like provided in the expansion board or the expansion section to perform a part or all of the actual operations based on instructions of the program code.

What is claimed is:

1. An image forming apparatus comprising:

an image forming device that forms images on sheets in accordance with image forming jobs;

a container detachably attached to the image forming apparatus for receiving and storing the sheets of different image forming jobs;

a conveying device that conveys the sheets on which the images have been formed to said container; and a controller that controls storage of the sheets on which the images have been formed in said container to selectively inhibit the storage of a next image forming job according to a priority level of a previous image forming job.

2. An image forming apparatus comprising:

an image forming device that forms images on sheets in accordance with an image forming job;

a container capable of being detachably attached to the image forming apparatus;

a conveying device that conveys the sheets on which the images have been formed to said container; and a controller that controls storage of the sheets on which the images have been formed in said container to selectively inhibit or allow the storage according to a priority level of the image forming job, wherein said controller is operable when the priority level of an image forming job to be executed is lower than the priority level of another image forming job for sheets stored in said container, for inhibiting the storage of sheets for the image forming job to be executed in said container.

3. An image forming apparatus comprising:

an image forming device that forms images on sheets in accordance with an image forming job;

a container capable of being detachably attached to the image forming apparatus;

a conveying device that conveys the sheets on which the images have been formed to said container; and a controller that controls storage of the sheets on which the images have been formed in said container to selectively inhibit or allow the storage according to a priority level of the image forming job, wherein said controller is operable when thc priority level of an image forming job to be executed is lower than the priority level of another image forming job for sheets stored in said container, for inhibiting execution of the image forming job to be executed.

4. An image forming apparatus comprising:

an image forming device that forms images on sheets in accordance with an image forming job;

a container capable of being detachably attached to the image forming apparatus;

a conveying device that conveys the sheets on which the images have been formed to said container; and a controller that controls storage of the sheets on which the images have been formed in said container to selectively inhibit or allow the storage according to a priority level of the image forming job, wherein said controller is operable when the priority level of an image forming job for sheets stored in said container is highest, for inhibiting storage of sheets in said container.

5. An image forming apparatus comprising:

an image forming device that forms images on sheets in accordance with an image forming job;

a container capable of being detachably attached to the image forming apparatus;

a conveying device that conveys the sheets on which the images have been formed to said container;

a controller that controls storage of the sheets on which the images have been formed in said container to selectively inhibit or allow the storage according to a priority level of the image forming job; and an input device that inputs an image forming job and the priority level of the input image forming job.

6. An image forming apparatus comprising:

an image forming device that forms images on sheets in accordance with an image forming job;

a container capable of being detachably attached to the image forming apparatus;

a conveying device that conveys the sheets on which the images have been formed to said container;

a controller that controls storage of the sheets on which the images have been formed in said container to selectively inhibit or allow the storage according to a priority level of the image forming job; and a setting device that sets the priority level of the image forming job.

7. An image forming apparatus comprising:

an image forming device that forms images on sheets in accordance with image forming jobs;

a discharge device that discharges the sheets of different image forming jobs on which the images have been formed by said image forming device; and a controller that controls said image forming device to selectively inhibit image formation of a next image forming job by said image forming device according to a priority level of a previous image forming job.

8. An image forming apparatus comprising:

an image forming device that forms images on sheets in accordance with image forming jobs;

a container detachably attached to the image forming apparatus for receiving and storing the sheets of different image forming jobs;

a conveying device that conveys the sheets on which the images have been formed to said container; and a controller that controls storage of the sheets on which the images have been formed in said container to selectively inhibit the storage of a current image forming job according to a priority level of a most recent image forming job stored in the container.

* * * * *